US009846005B2

(12) United States Patent
Zivic et al.

(10) Patent No.: US 9,846,005 B2
(45) Date of Patent: Dec. 19, 2017

(54) MAGAZINE LOADER DEVICE

(71) Applicants: Jernej Zivic, Izola (SI); Jozef Lorbek, Izola (SI)

(72) Inventors: Jernej Zivic, Izola (SI); Jozef Lorbek, Izola (SI)

( * ) Notice: Subject to any disclaimer, the term of this patent is extended or adjusted under 35 U.S.C. 154(b) by 0 days.

(21) Appl. No.: 15/309,006

(22) PCT Filed: Apr. 29, 2015

(86) PCT No.: PCT/SI2015/000017
§ 371 (c)(1),
(2) Date: Nov. 4, 2016

(87) PCT Pub. No.: WO2015/171081
PCT Pub. Date: Nov. 12, 2015

(65) Prior Publication Data

US 2017/0067707 A1 Mar. 9, 2017

(30) Foreign Application Priority Data

May 5, 2014 (SI) ..... P-201400165

(51) Int. Cl.
*F41A 9/83* (2006.01)
*F41A 9/82* (2006.01)
*F41A 9/84* (2006.01)

(52) U.S. Cl.
CPC ..... *F41A 9/83* (2013.01); *F41A 9/82* (2013.01); *F41A 9/84* (2013.01)

(58) Field of Classification Search
CPC ..... F41A 9/82–9/87; F41A 9/88
(Continued)

(56) References Cited

U.S. PATENT DOCUMENTS 4,719,715 A * 1/1988 Howard ..... F41A 9/83 42/87
4,939,862 A * 7/1990 Brandenburg ..... F41A 9/83 42/87

(Continued)

OTHER PUBLICATIONS

PCT International Search Report and Written Opinion for International Application No. PCT/SI2015/000017 dated Sep. 25, 2015.

*Primary Examiner* — John Cooper
(74) *Attorney, Agent, or Firm* — Ziolkowski Patent Solutions Group, SC

(57) ABSTRACT

The present invention discloses a magazine loader device (1) for firearms which consists of a lower section (1A) and upper section (1B). The upper section (1B) receives individual vertically-oriented cartridges from the hopper (61), turns them in the right direction using a rotating mechanism (32, 33, 34, and 35), which is the essential part of the upper section (1B), and pushes them towards the lower section (1A). The lower section (1A) pushes the correctly facing cartridges (N) into the magazine (20) which is inserted into the hollow grip (21B, 22B) of the lower section (1A). The tripping plunger (17) is an essential element of the lower section (1A) which in cooperation with the controlling curve (13E) pushes the cartridge pusher (20A) or the preceding cartridge down by a characterized in that, enables the next cartridge to enter the magazine, and timely retracts, so the cartridge (N) can be pushed into the magazine until the end. The lower section (1A) of the device can also be used independently.

14 Claims, 27 Drawing Sheets

(58) Field of Classification Search
USPC ..... 89/33.01, 33.5, 34; 42/88, 90, 87, 106; 86/23, 25, 45, 46, 47
See application file for complete search history.

(56) References Cited

U.S. PATENT DOCUMENTS

| | | | | |
|---|---|---|---|---|
| 5,301,449 | A | 4/1994 | Jackson | |
| 9,003,687 | B2 * | 4/2015 | Cauley, Jr. | F41A 9/83 42/88 |
| 2005/0081421 | A1 * | 4/2005 | Guy | F41A 9/83 42/88 |
| 2010/0175294 | A1 * | 7/2010 | Meinel | F41A 9/83 42/87 |
| 2014/0298704 | A1 * | 10/2014 | Niccum | F41A 9/83 42/87 |
| 2014/0317985 | A1 * | 10/2014 | Cauley, Jr. | F41A 9/83 42/87 |

* cited by examiner

1

MAGAZINE LOADER DEVICE

TECHNICAL FIELD

The subject of invention is a magazine loader device and it relates to firearms, particularly to the field of devices for loading magazines of firearms.

DEFINITION OF TERMS USED

According to the present invention the user holds the device by the hollow grip in which a magazine has been placed as he would hold a pistol.

The description of the present invention includes the following directions (left, right, top, bottom, front and rear) viewing from the perspective of the device user. The "front part of the cartridge" means the bullet side of the cartridge; on the other hand the "rear part of the cartridge" means the end with the blind side of the cartridge sleeve.

DESCRIPTION OF THE TECHNICAL PROBLEM

As shown in FIG. 3A, the magazine 20 consists of a substantially vertical box-shaped housing which in its interior contains a normal helical coil spring which extends upwards from the base of the housing, at the top of which is a cartridge holder or the so-called magazine cartridge pusher 20A which engages the cartridge that was inserted into the magazine first.

The magazine housing is encased at the lower end and open at the top end. The distance between the longer vertical planes of the housing narrows towards the top of said housing of magazine 20. When the magazine is empty, the pusher 20A remains at the height where said narrowing of the housing 20B starts.

Thus, the feeding compartment is obtained in the upper front end of the magazine housing, into which the first cartridge can be placed on the pusher from the upper side in such a way that a smaller part of the cartridge protrudes through the front narrower plane of the housing, where it is pushed downwards on the pusher and back, so the cartridge slides onto the pusher 20A and with its rear side rests on the rear narrower side of the housing. Thus, the first cartridge is secured below by the pusher, on the top it is secured with the narrow end of the housing, while the rear area is restricted by the rear narrow side of the housing.

During loading of each cartridge into the magazine, the pusher moves a notch downwards. In the next and each subsequent step a cartridge is inserted onto a previous cartridge, pushing it further downward, whereby all previously loaded cartridges and the pusher 20A move a notch down. The cartridge is then pushed back to slide onto the previous cartridge to the back narrow surface of the housing.

The manual loading process is a time consuming operation which also requires certain skills and strength of the person loading the magazine.

STATE OF THE ART

Only magazine loader accessories are known in the art (e.g. type "uplula", "HKS", "XD magazine Loader"), which operate on the principle of "helping" pushing the magazine cartridge pusher or the top cartridge. All accessories of this type require inserting cartridges manually, one by one, and then lifting such accessory and pushing a cartridge into the magazine manually, by hand.

A device of such type is also described in published patent application filed Jan. 13, 2010 in the U.S. application Ser. No. 12/686,629 entitled title "Rapid pistol magazine loader", of inventor Edward Steele Meinel, Reston, US.

The invention described in said application suggests insertion of cartridges manual or using specially adapted cartridge packaging. Drive of this device is not shown in patent application, however the proposed operating mode indicates that the device is manually operated in both directions, and elements are guided through the side slots, with variable direction. The description of the device is unclear, and therefore, its operation is questionable, especially regarding synchronization of movements of individual elements, whereby loading of cartridges into the magazine should be enabled.

The disadvantage of above-described solution according to the state of the art lies in the fact, that it is necessary to push a cartridge into the magazine by hand, which is strenuous for the person doing this, or special packaging where cartridges have been already sorted, is required.

BRIEF DESCRIPTION OF THE INVENTION

As described below, the present invention solves the technical problem by introducing a device 1 (FIG. 1), which allows easy loading of cartridges into the magazine, wherein the device according to the present invention, comprises also a sorting section, sorting the cartridges which come from a hopper, turning each cartridge in the right direction and feeds it to the lower section of the device, facing in the right direction.

The device 1 according to the present invention consists of two basic sections, namely a lower section 1A and an upper section 1B. The lower section 1A represents housing with an exchangeable grip, movable lock and tripping plunger. Individual cartridges, facing the right direction, are manually inserted into the housing, where in the return stroke latch pushes them into the magazine, inserted and secured in the hollow part of the grip.

The lower section 1A of the device 1 can be used independently or in combination with the upper section 1B of the device 1.

The upper section 1B consists of a housing which includes a rotating mechanism for turning the cartridges, above which a hopper is provided, into which multiple cartridges are freely dropped and from which individual cartridges fall into the rotating mechanism in a vertical position. Individual cartridge always drops into the rotating mechanism vertically and may be oriented with the bullet facing down or with the sleeve facing down. The rotating mechanism detects the orientation of the cartridge, and depending on its orientation, it rotates it, so the cartridge falls always with the bullet facing down into the inlet opening of the lower section of the device.

BRIEF DESCRIPTION OF DRAWINGS

The said invention is further described referring to the enclosed drawings, showing.

DETAILED DESCRIPTION OF THE INVENTION

Figure 1:
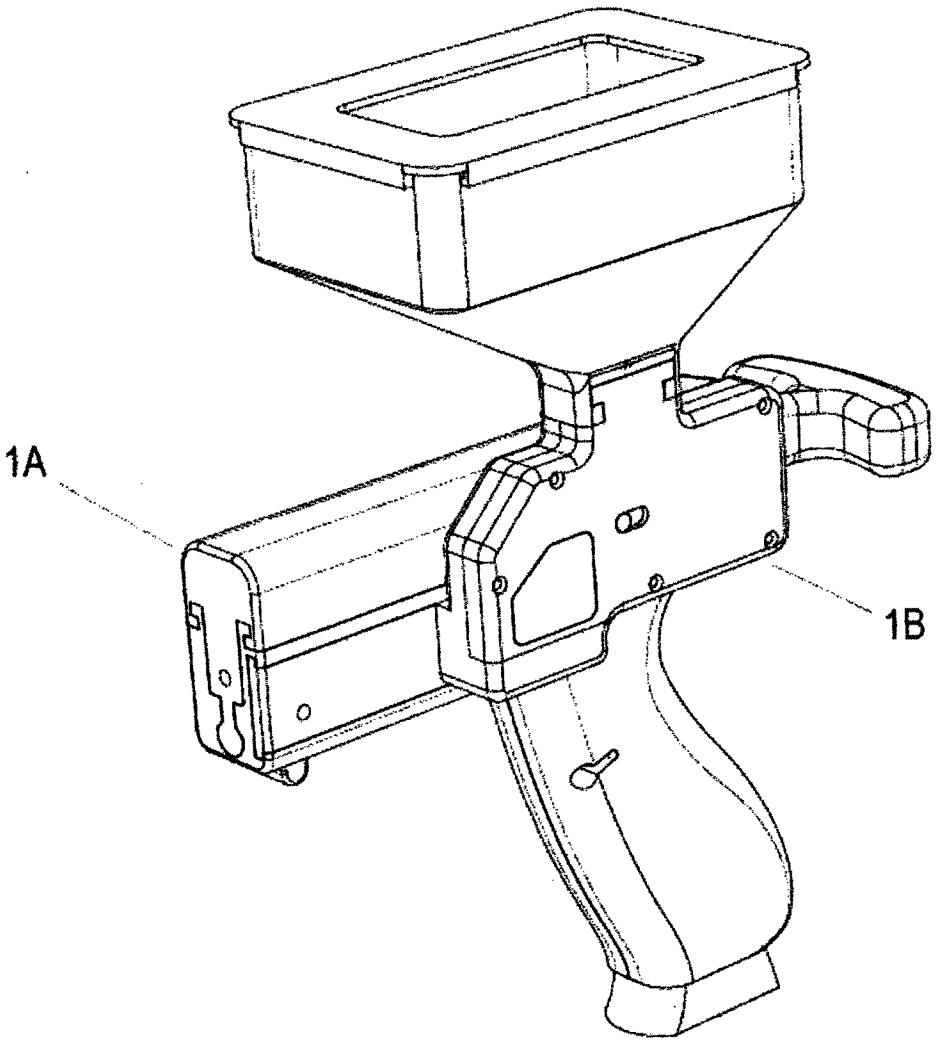
FIG. 1: The device 1 according to the present invention, assembled.
Figure 2:
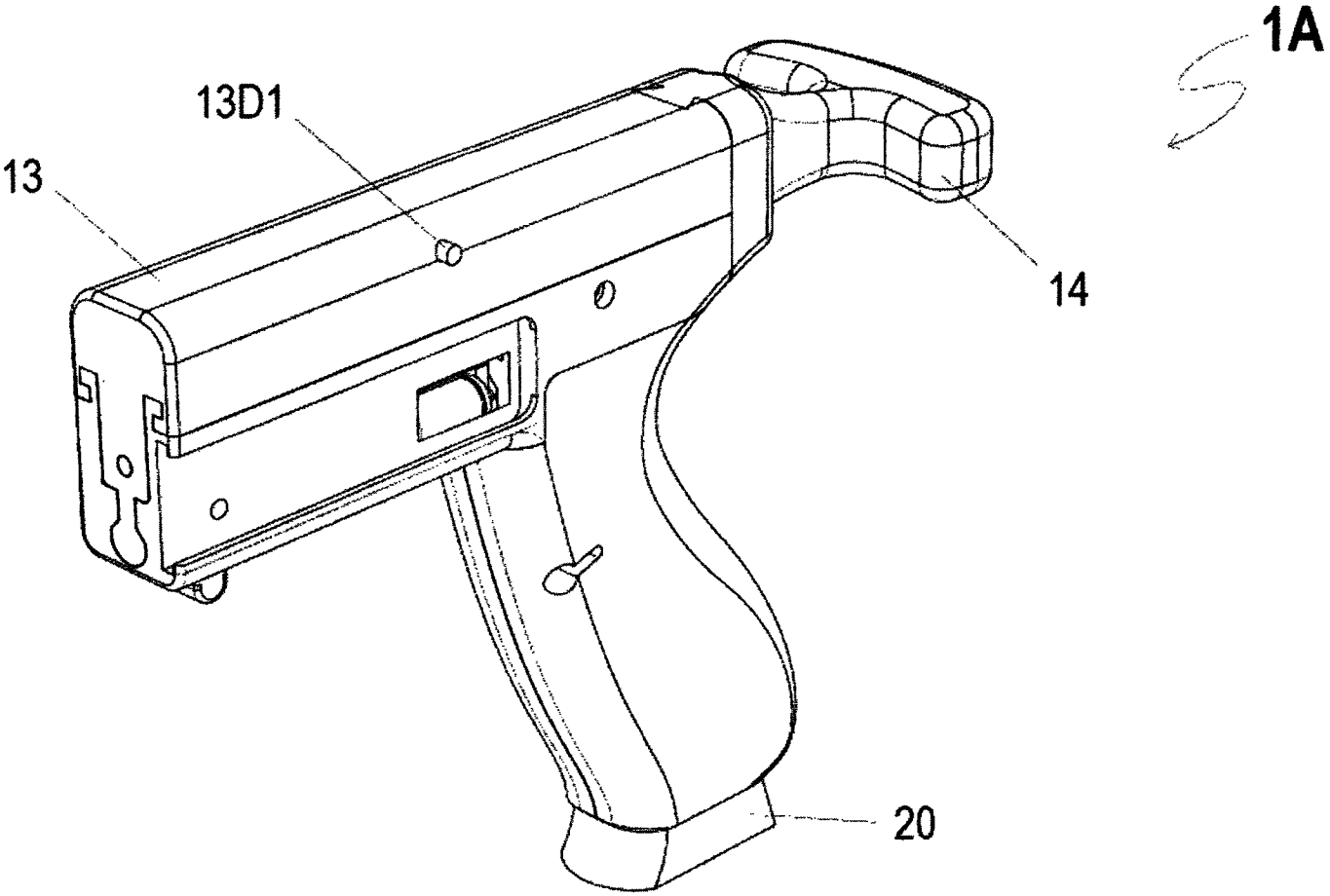
FIG. 2: The lower section 1A of the device according to the present invention, assembled.
Figure 3A:
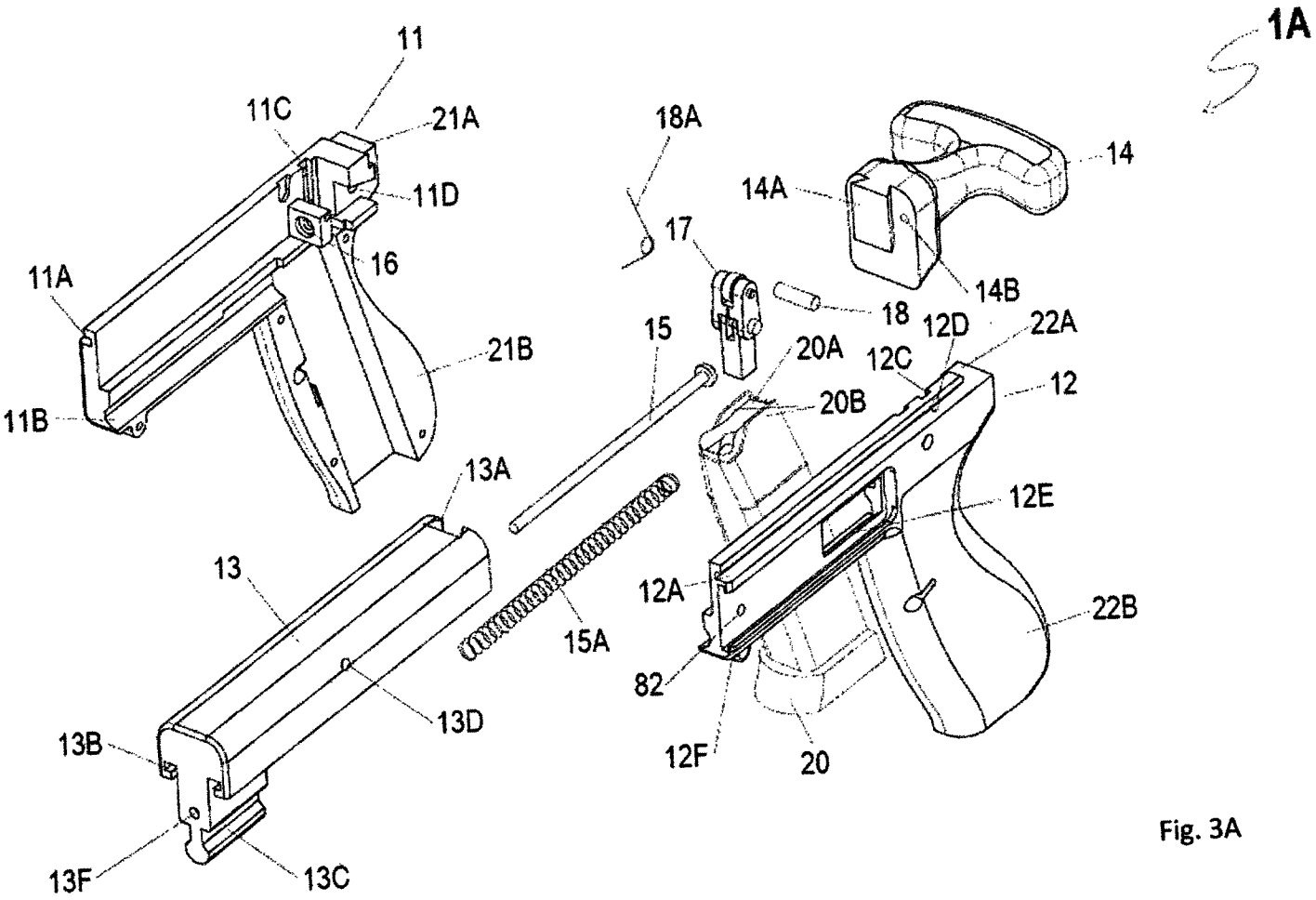
FIG. 3A: The lower section 1A of the device according to the present invention in disassembled state, front and top left side view.
Figure 3B:
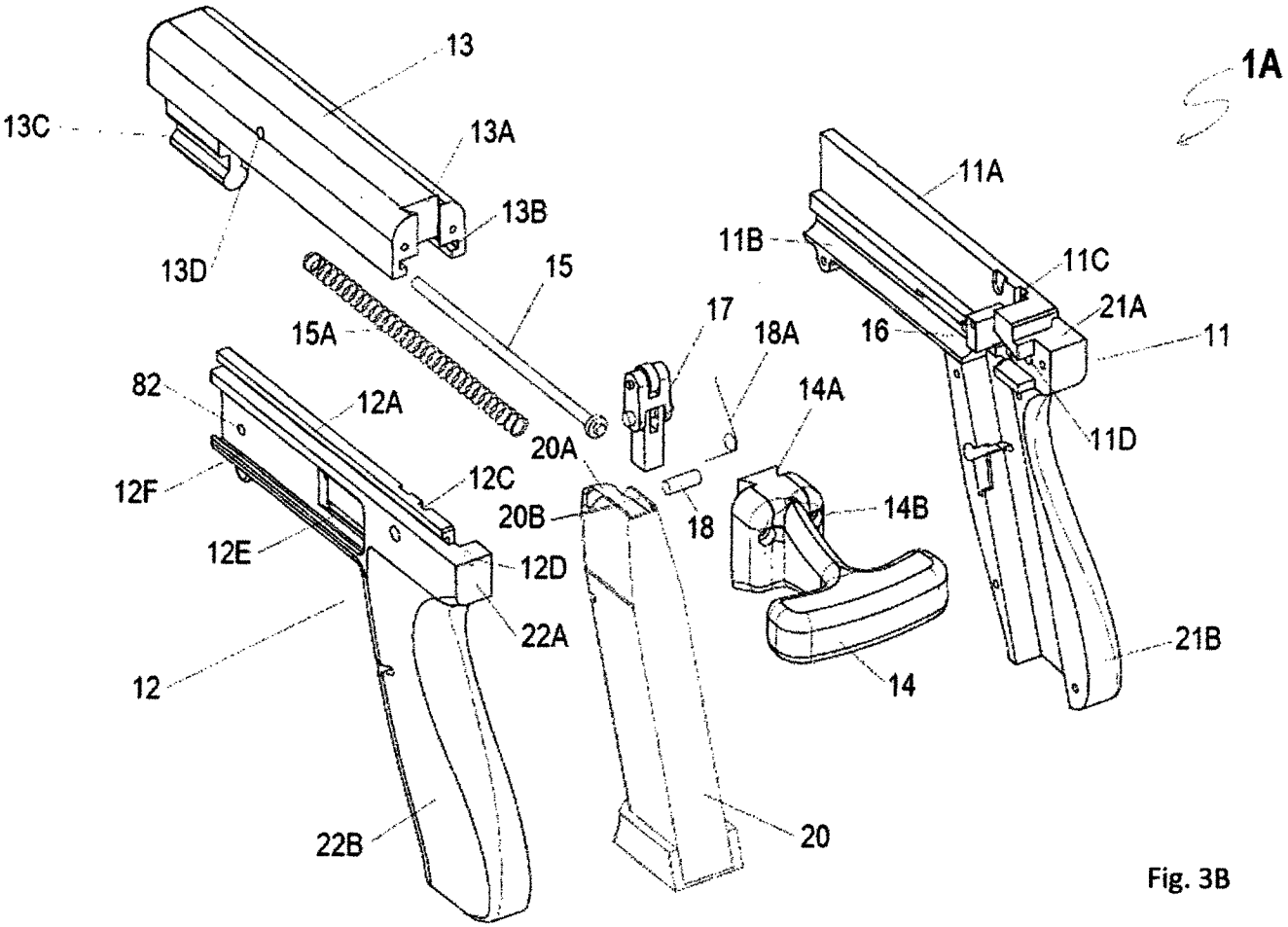
FIG. 3B: The lower section 1A of the device according to the present invention in disassembled state, rear and top left side view.

FIGS. 2, 3A and 3B show the lower section 1A of the device 1 according to the present invention. The lower section 1A consists of the right part of the housing 11, the left part of the housing 12, latch 13 and pull handle 14.

The right part of the housing 11 consists of the top part 21A and the lower part 21B, analogously the left part of the housing 12 consists of the top part 22A and the lower part 22B, respectively. The said top parts 21A, 22A and lower parts 21B, 22B are coupled together pairwise in a detachable manner so that the lower parts 21B and 22B can be replaced, if necessary. Such detachable coupling may include appropriate sliding guides with lock bolt, bolted connection, etc.

The said lower parts 21B, 22B in assembled state form a hollow grip for insertion of magazine 20 to be charged; therefore the possibility of replacement is necessary so the device can be used with different magazines.

The said pull handle 14 and latch 13 are detachably coupled by means of a dovetail 13A, 14A or similar coupling and secured with a screw or spring pin 14B. The latch 13 has on the lower portion upper guides 13B, running alongside the entire latch 13, and lower guides 13C running essentially alongside the front quarter of the latch 13.

During operation of the device 1 the upper guides 13B of the latch 13 slide on corresponding guides 12A on the outer side of the left part of the housing 12, and 11A on the outer side of the right part of the housing 11, while the lower guides 13C slide on the corresponding guides 12B on the internal side of the left side of the housing 12, and 11B on the internal side of the right part of the housing 11.

Figure 4:
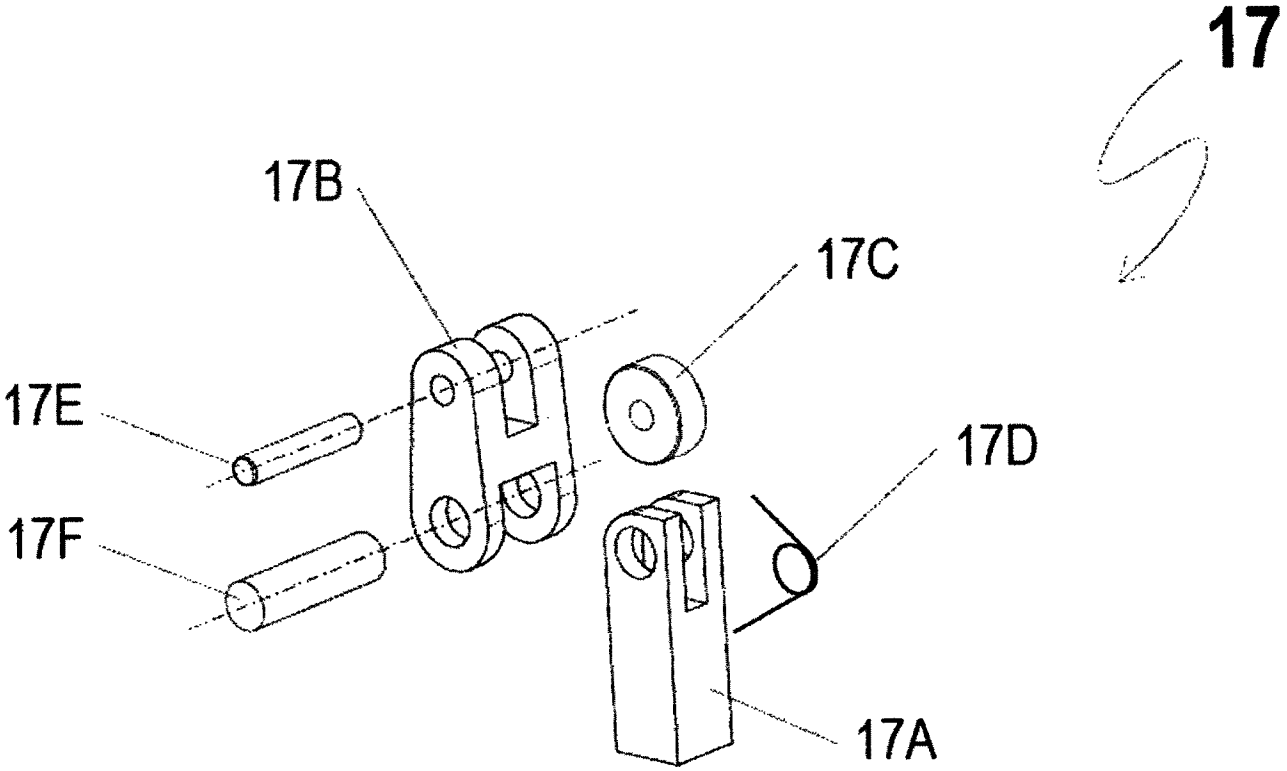
FIG. 4: Tripping plunger

Under the upper guides 13A and above the lower guides 13C of the latch 13, parallel to said guides, runs an opening 13F for receiving a guiding rod 15 of a spring 15A, here the guiding rod is fixed into the holder 16. Behind the said holder 16 the tripping plunger 17 is positioned, detailed in FIG. 4, consisting of the lower portion 17A and the upper portion 17B, wheel 17C that rotates freely on a pin 17E and the spring 17D. The said elements of tripping plunger 17 are joined by two connecting pins 17E and 17F, where the pin 17E connects the upper portion of the tripping plunger 17B and the wheel, while the pin 17F connects the upper and lower portion of the tripping plunger 17A, 17B and the spring 17D.

The tripping plunger slides on corresponding vertical guides 12C of the left part of the housing and 11C of the right part of the housing, while the wheel 17C runs along the controlling curve 13E shown in FIGS. 5A to 5G.

In the assembled state, both parts 17A and 17B are mutually movable around the axis of the pin 17F only when the upper part 17B rotates forward by approximately 90°, while backward rotation is disabled with square formed upper rear part of the lower end 17A of the tripping plunger 17.

In order to provide return vertical motion of the tripping plunger 17, the device contains a spring 18A which is with pin 18 engaged in the grooves of the housing 11D and 12D (FIG. 3A). The spring 18A pushes with its lover arm to the lover area of the housing, while the upper arm is located in the cavity of the tripping plunger 17, under the pin 17F, so the spring 18A is preloaded. When tripping plunger 17 travels downwards, the pin 17F tensions the spring 18A.

As shown in FIGS. 3A and 3B, the most part of the lock 13, approximately along the last three quarters, is hollow. The interior of the top wall of lock 13 has a double-hump controlling curve 13E, by means of which it controls the tripping plunger 17 with a wheel 17B, so the plunder 17 periodically travels in vertical direction along the corresponding vertical guides of left part of the housing 12C and right part of the housing 11C.

The said left hand side of the housing 12 of the lower section 1A of the device 1 has a side opening 12E in the upper central part, through which a cartridge is inserted into the device, either manually or as described hereunder, by means of the upper section 1B of the device 1.

The said left side of the housing 12 has longitudal outer guides 12F, positioned on its outer side, where the upper section 1B of the device 1 is fixed, as described below, while the left side of latch 13 has an opening 13D for receiving a pin 13D1 (FIG. 2) running through the slot 34B of the outer fork 34 of the upper section 1B (FIG. 9B), whereby it provides a synchronized drive of the upper section 1B of the device 1.

Description of Operation of the Lower Section

Operation of the lower section 1A of the device 1, according to the present invention is demonstrated by individual steps in FIGS. 3A to 3G, namely in longitudinal section.

Figure 5A:
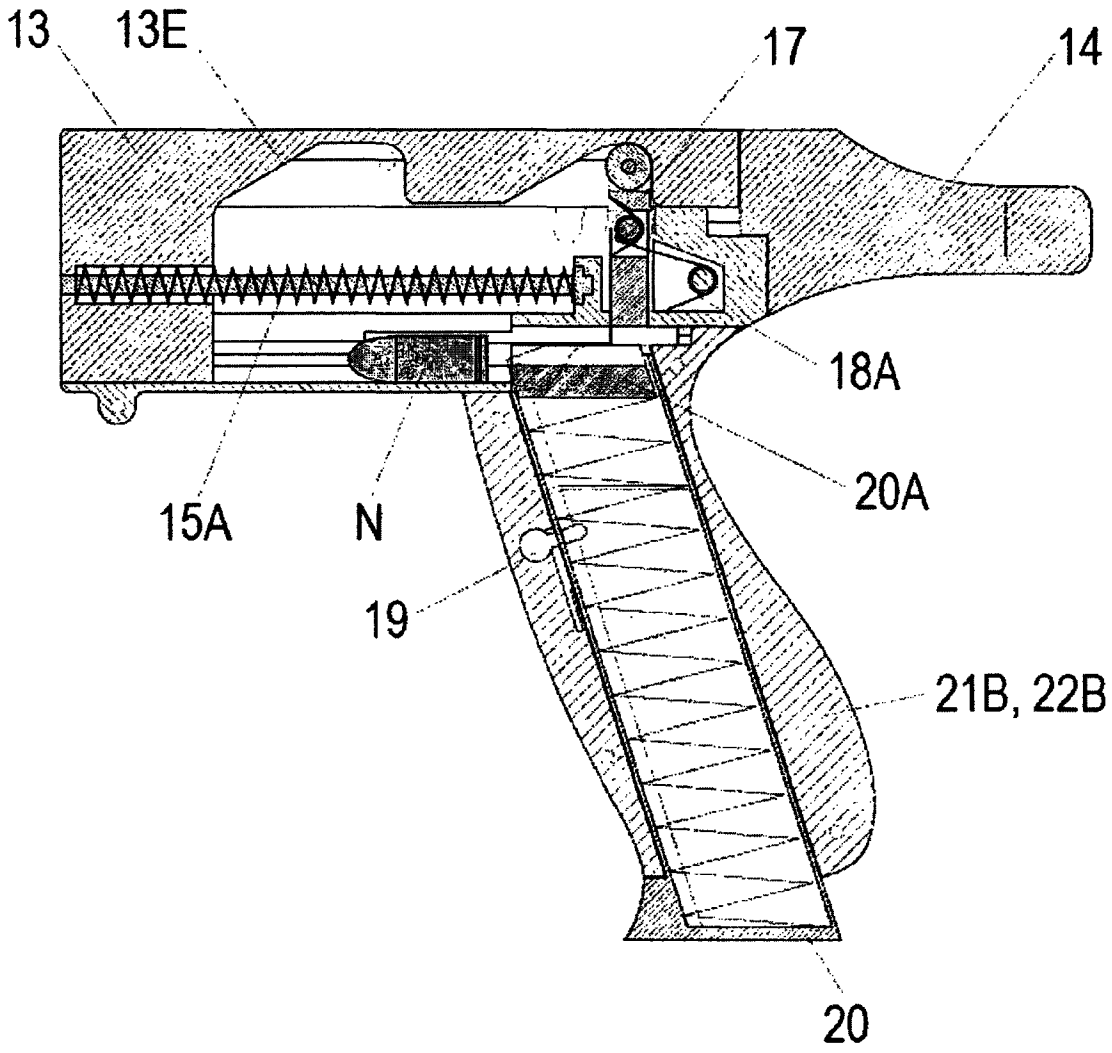
FIG. 5A: The lower section 1A according to the present invention, in longitudinal section, with inserted cartridge, the latch in the first/initial position.
Figure 5B:
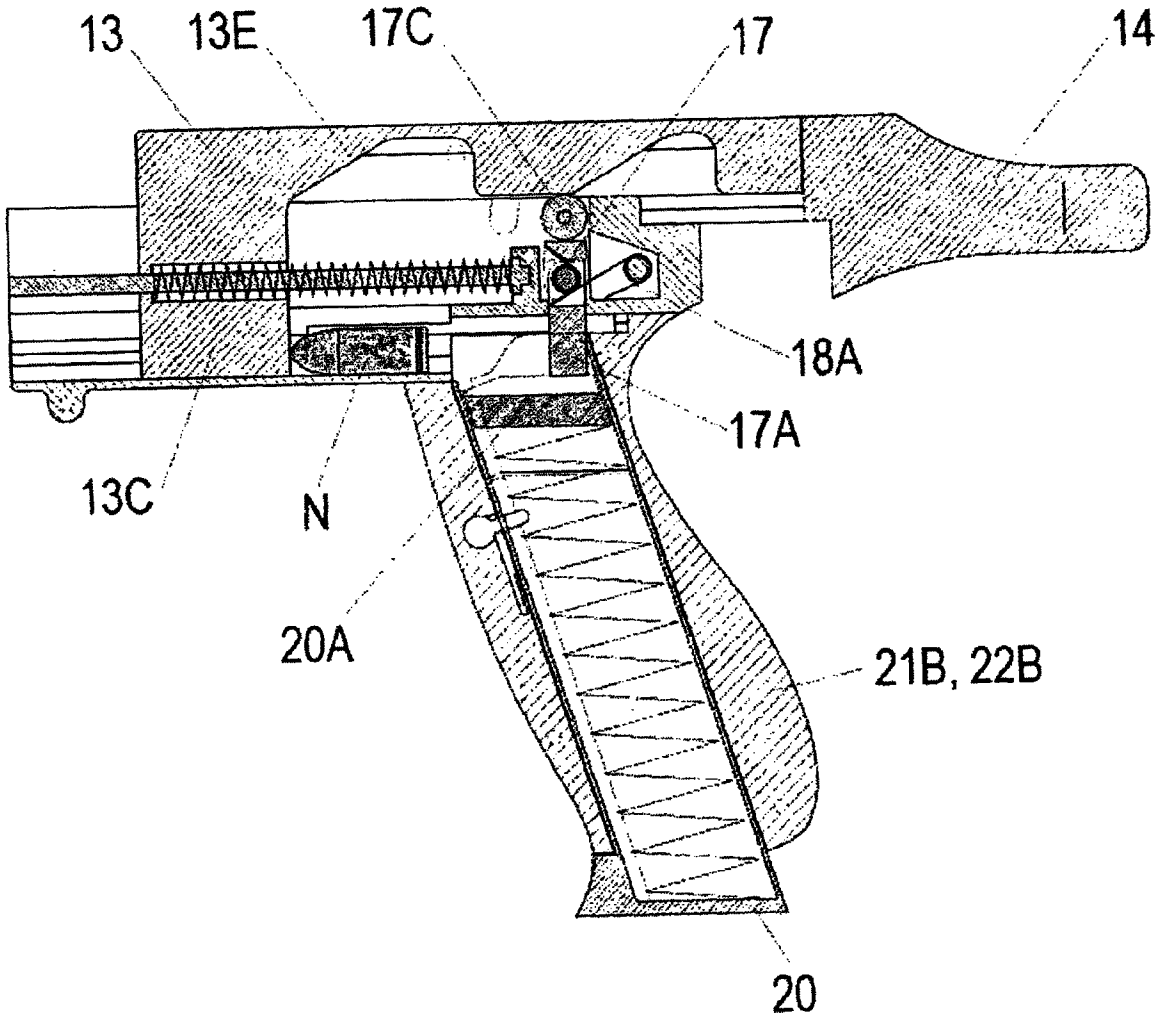
FIG. 5B: The lower section 1A according to the present invention, in longitudinal section, with inserted cartridge, the latch in the second position.
Figure 5C:
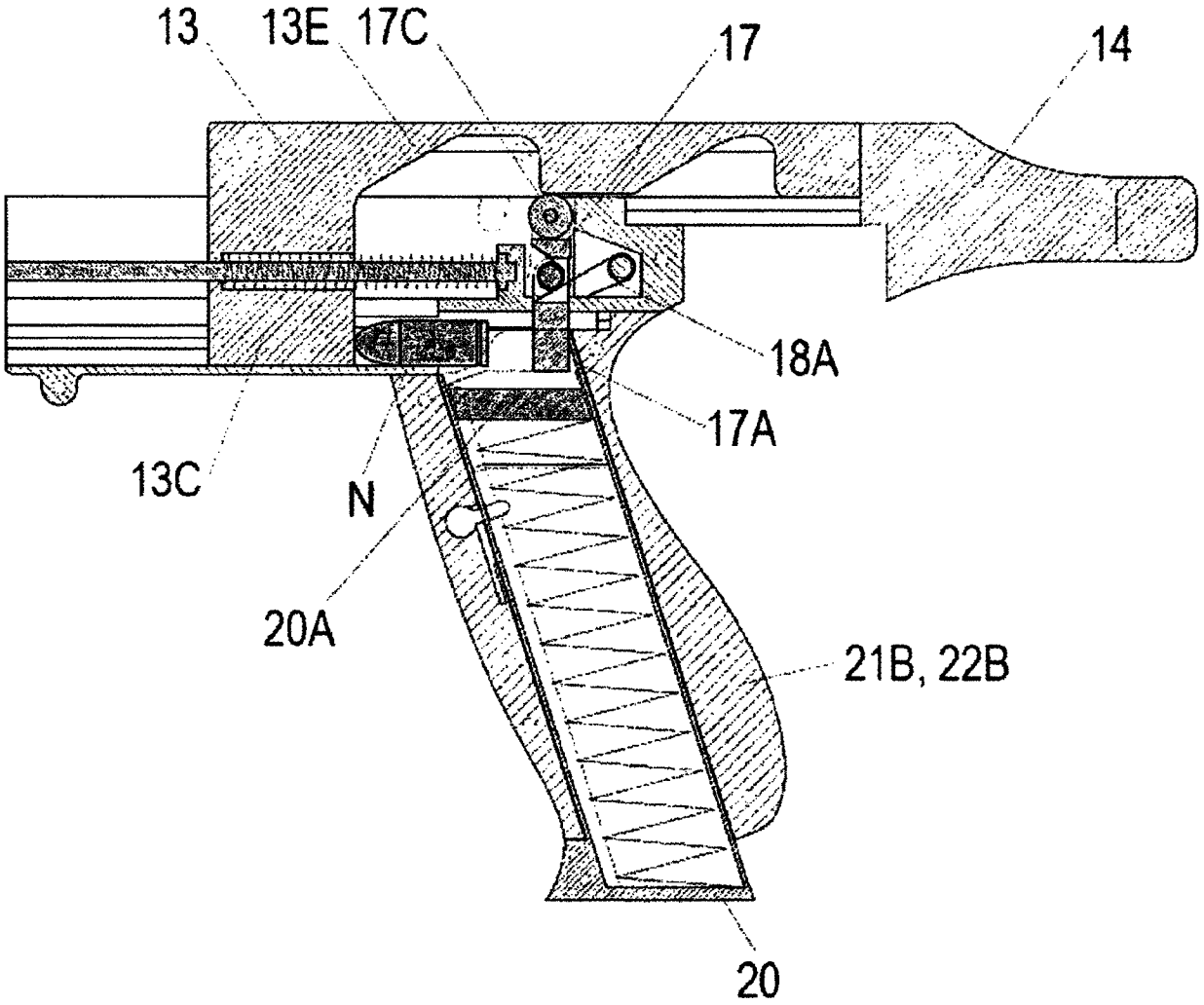
FIG. 5C: The lower section 1A according to the present invention, in longitudinal section, with inserted cartridge, the latch in the third position.
Figure 5D:
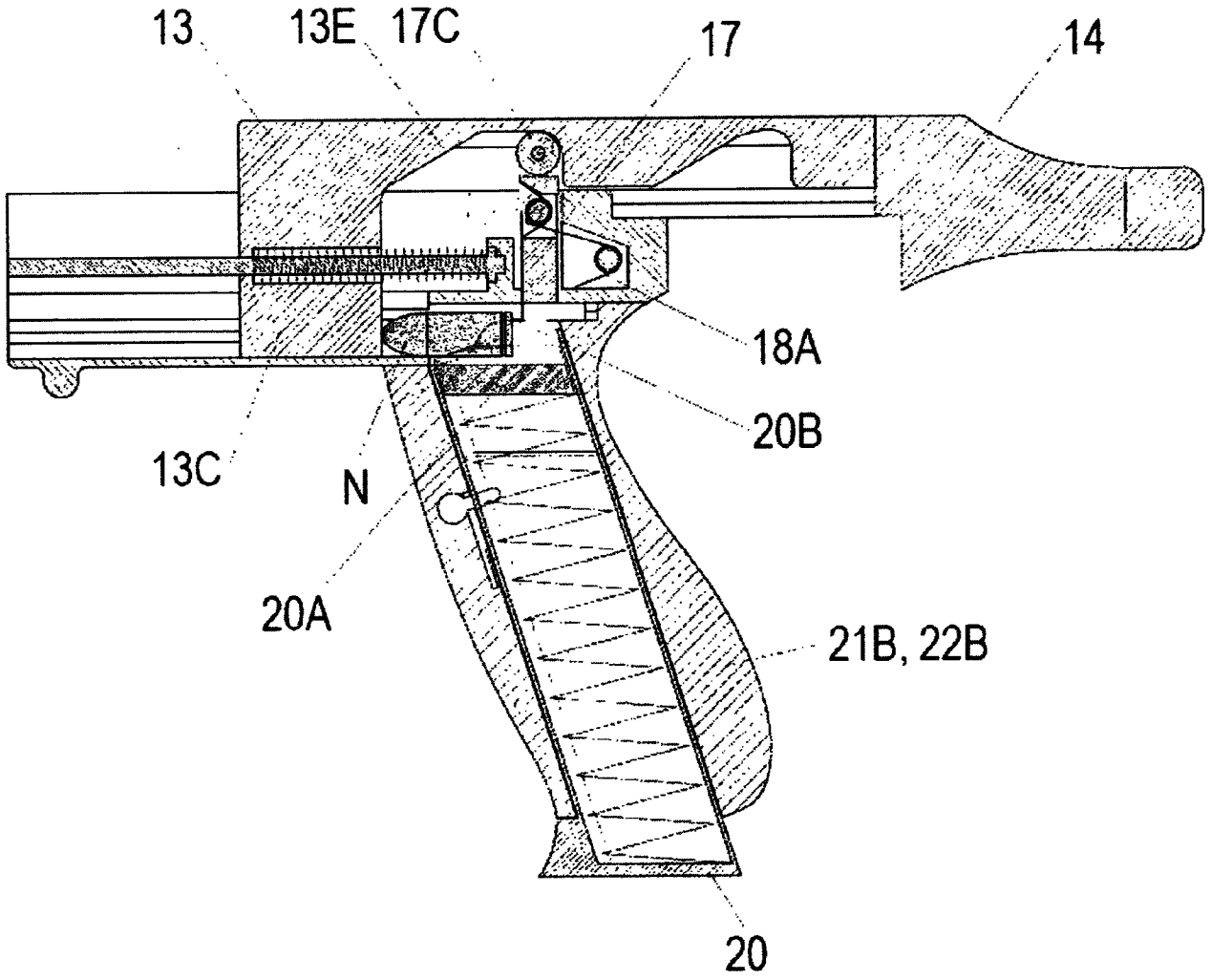
FIG. 5D: The lower section 1A according to the present invention, in longitudinal section, with inserted cartridge, the latch in the fourth position.
Figure 5E:
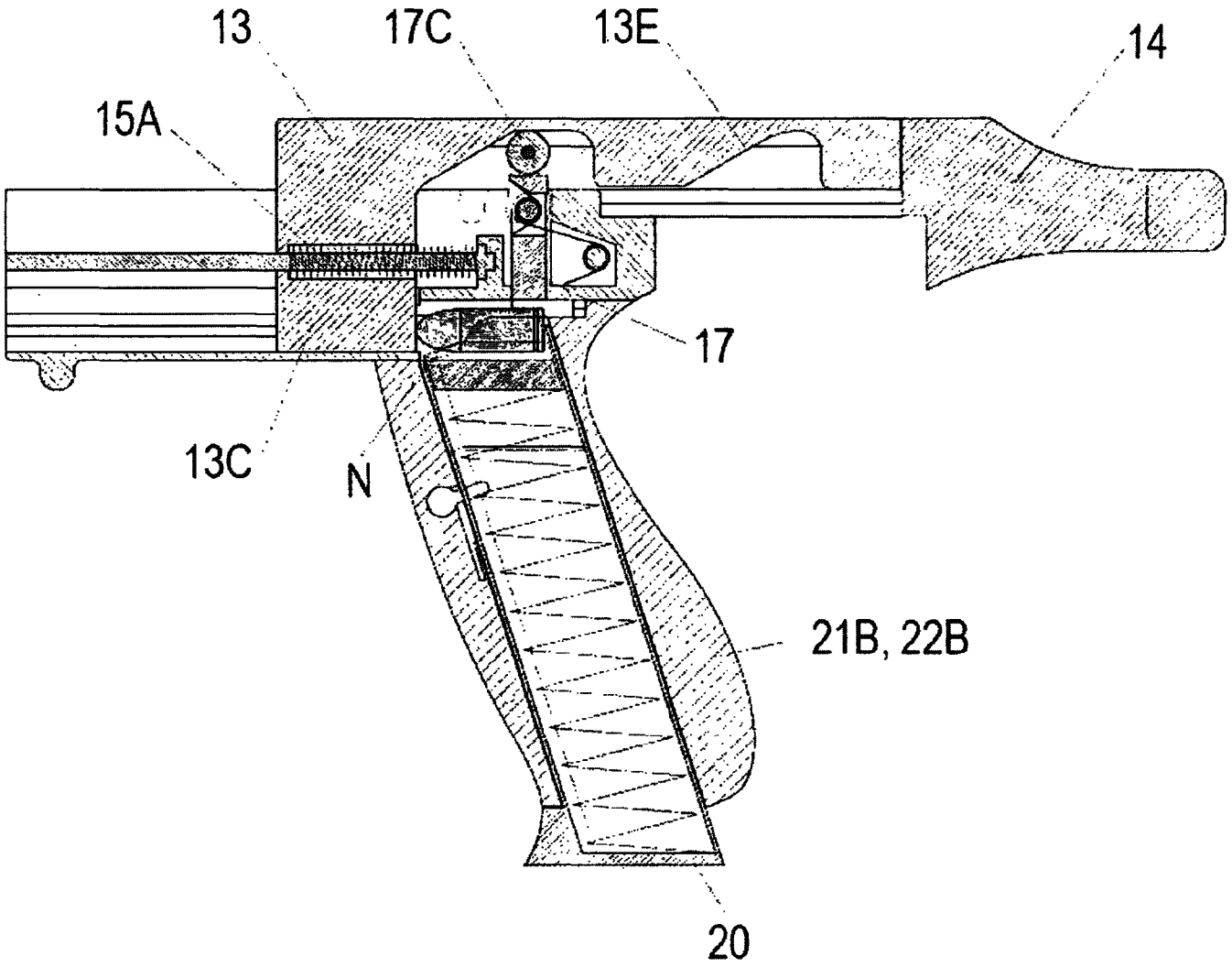
FIG. 5E: The lower section 1A according to the present invention, in longitudinal section, with cartridge pushed in the magazine—the latch in the fifth/final position.

FIG. 5A shows the lower section 1A of the device 1 in a starting position. The spring 15A pushes the latch 13 in the most front position. An empty magazine 20 is inserted into the cavity of the grip 21B, 22B from the bottom side, fixed and secured against falling out by means of a latching member 19. The tripping plunger 17 is in the upper position pushed by the spring 18A. A cartridge N, facing correctly is inserted through the opening 12E. The user holds the lower part 1A with one hand and with the other pulls the latch 13 back, towards him, by means of the pull handle 14.

In the second step (FIG. 5B), the latch is moved back, to such a distance that the controlling curve 13E pushes the tripping plunger 17 by means of the wheel 17C in its lowest position so that the bottom part of the tripping plunger 17A pushes the cartridge pusher 20A downwards, while at the same time latch 13 with guides 13C reaches cartridge N. The spring 18A is in the bottom, most tense position.

In the third step (FIG. 5C), the latch 13 is moved back to such a distance to move the cartridge N for about a third of its length into the magazine 20, the tripping plunger 17 travels by means of wheel 17C along the flat part of the curve 13E and does not move vertically.

In the fourth step (FIG. 5D), the latch 13 is moved back to such a distance that the spring 18A raises the tripping plunger 17 in the uppermost position, and the latch 13, with the rear side of guides 13C, pushes cartridge N into the magazine 20. The cartridge N travels onto the pusher 20A in the upper part being clamped by the curved upper part of the magazine 20, so that the pusher 20A cannot push it upwards.

In the fifth step (FIG. 5E), the latch 13 is moved to its rearmost position, while the tripping plunger 17 travels by means of wheel 17C along a straight section of the curve 13E and remains in the uppermost position; the cartridge N is pushed into the magazine to the end. The spring 15A is in its most tensed position.

Now the user releases the force pulling the latch 13 by means of pull handle 14 toward the body, and the spring 15A in a return stroke pushes the latch 13 towards the starting position.

Figure 5F:
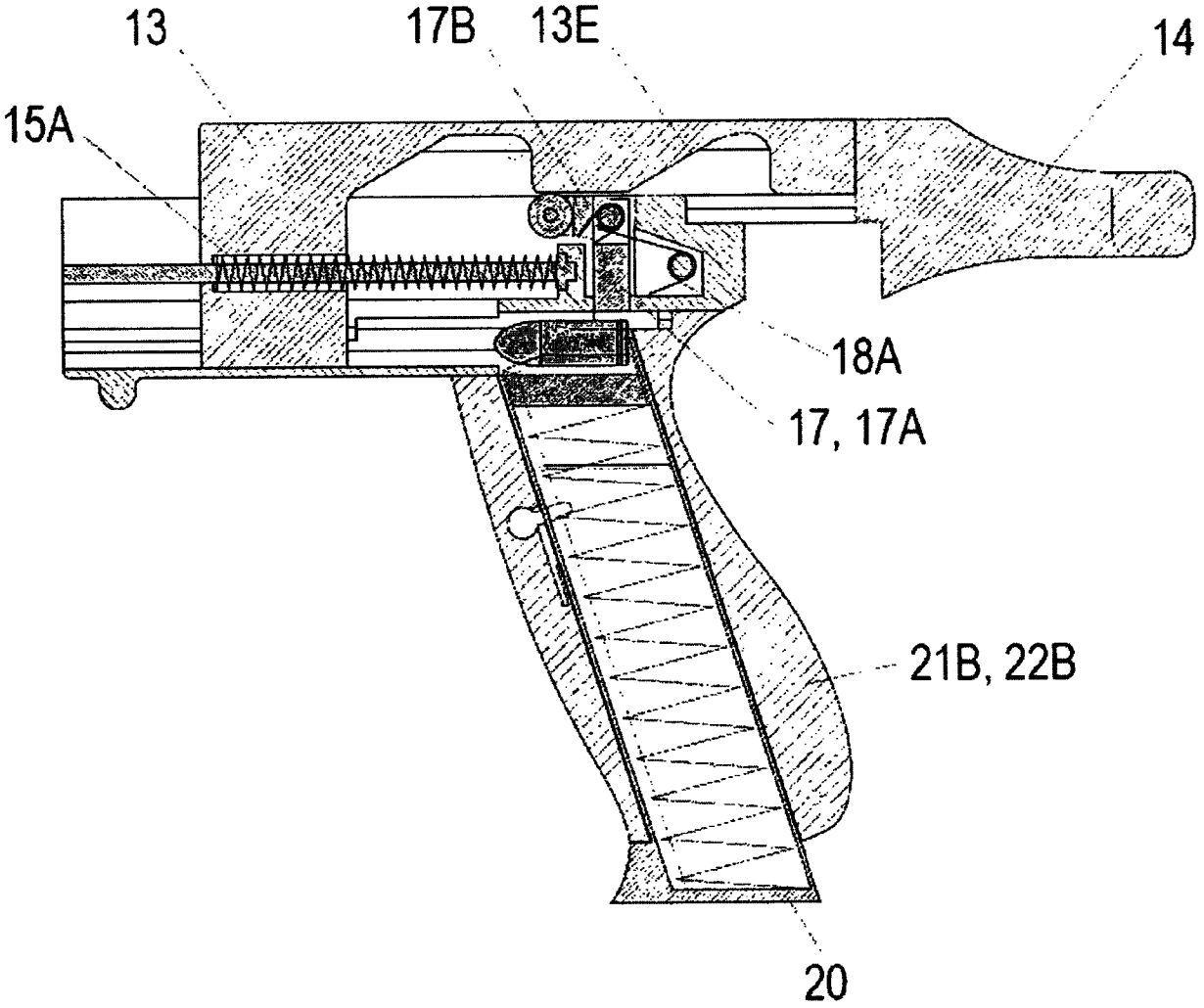
FIG. 5F: The lower section 1A according to the present invention, in longitudinal section, with inserted cartridge—the latch halfway through return stroke.

The FIG. 5F shows the first step of the return stroke towards the starting position. The tripping plunger 17 withdraws with its upper portion 17B from the vertical part of the curve 13E by pivoting forward around the axis of the pin 17F by approximately 90°, and consequently, the lower part 17A of the tripping plunger 17 does not move downward, whereby the entire tripping plunger 17 also pushes the spring 18A upwards.

Figure 5G:
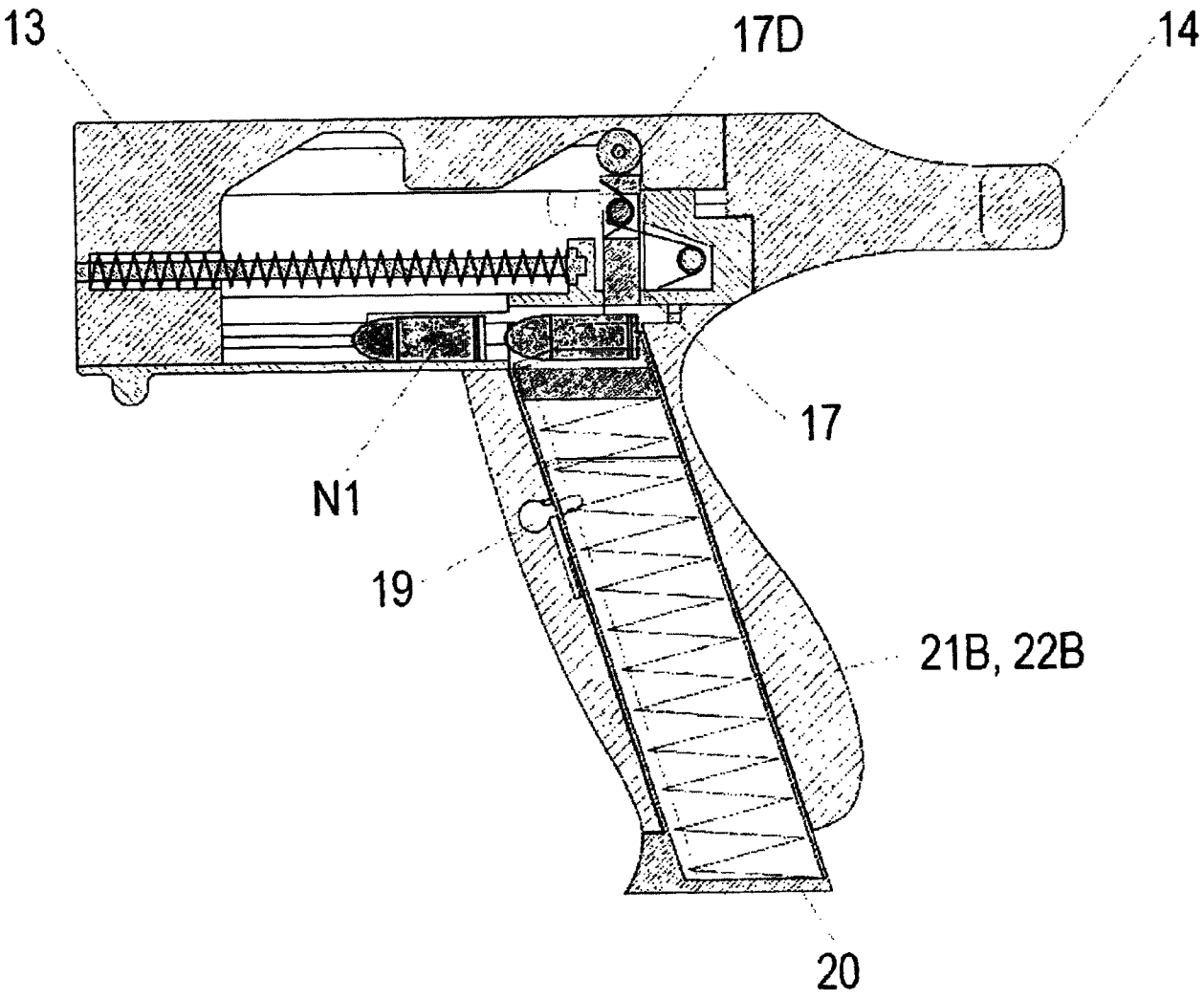
FIG. 5G: The lower section 1A according to the present invention, in longitudinal section, with inserted cartridge—the latch once more in the first/initial position, a next cartridge is inserted.
Figure 6:
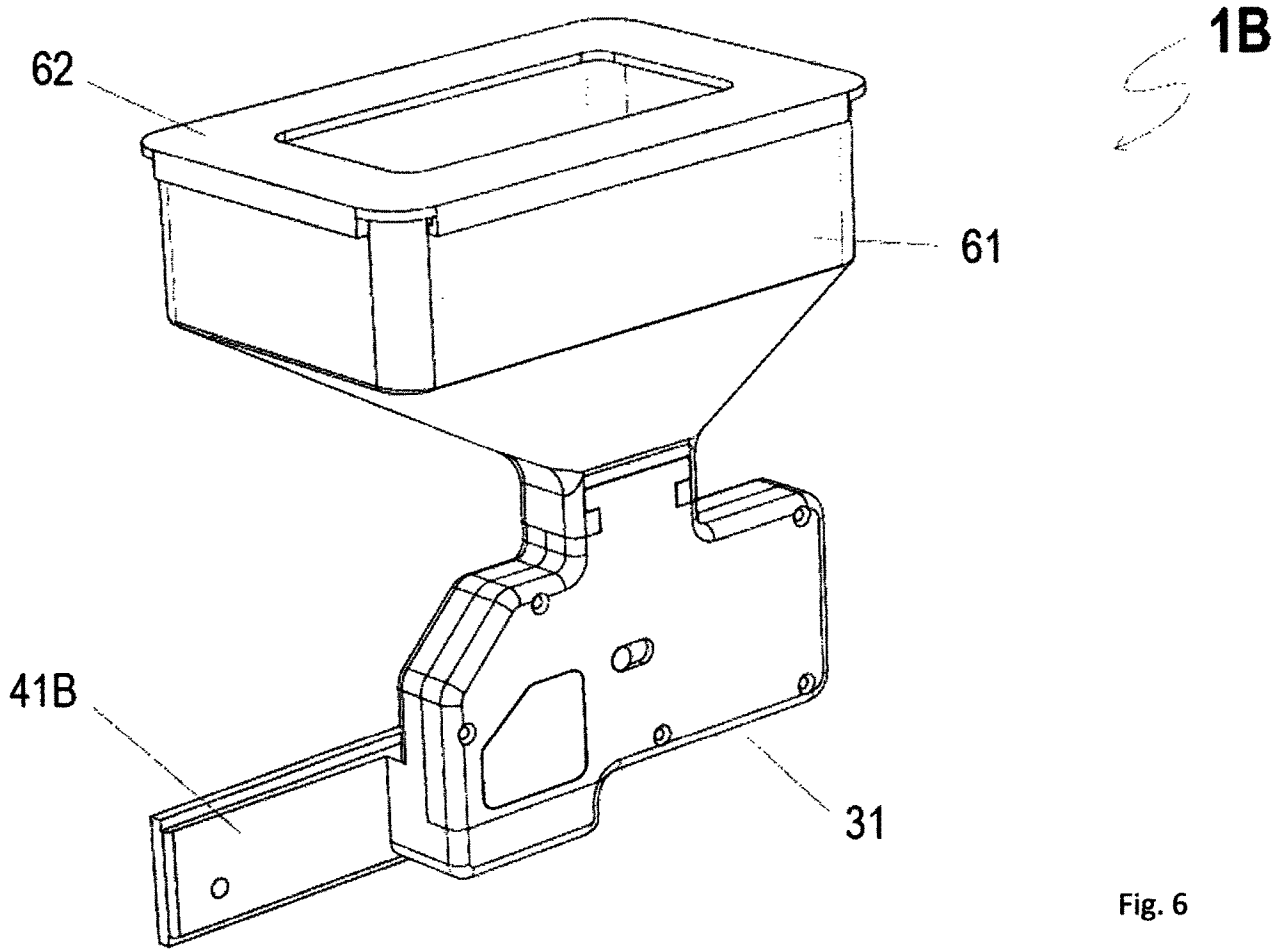
FIG. 6: The upper section 1B of the device according to the present invention in the assembled state.

The FIG. 5G shows the lower section of the device 1A in a starting position. The spring 17A returns the upper part of the tripping plunger in a straight position. The next cartridge N1 is inserted into the device.

Repeating the above-described cycle, the plunger 17 pushes the cartridge deeper into the magazine, thus making room for the next cartridge N1. The user repeats the cycle until the magazine 20 has been loaded to the desired extent, then withdraws it from the cavity of the handle 21B, 22B by releasing the latching member 19 and inserts the next one.

Upper Section of the Device

FIGS. 6, 7, 8A and 8B show the upper section 1B of the device 1 according to the present invention, consisting of a housing 31 comprised of the right part of the housing 41 and the left part of the housing 51 which are joined by bolts (not shown). The right part of the housing 41 has on its right-hand side a sliding rail 41B that fits to the guides 12F of the left part of the housing 12 of the lower section 1A of the device 1 described above. The opening 81 on the sliding rail 41B and the opening 82 in the left part of the housing 12 overlap in order to receive a connecting pin (not shown), which interconnects the lower part 1A and the upper part 1B of the device 1.

The said right part of the housing 41 has on the lower portion a shaped opening 41C extending through the part of the housing 41 and through the guides 41B through which facing correctly cartridges enter from the upper section 1B to the bottom section 1A of the device 1.

The said right and left parts of the housing 41, 51 have opposite and elongated recessed areas 41D, 51D which have in the central part two slots 41A, 51A where a freely rotating wheel 35 is mounted. The lower fork 32 which is clamped in the corresponding recesses 32A in both portions of the housing 41, 51 is positioned under the rotating wheel 35.

The housing 31 also contains a rotating wheel 35 and rear fork 33 which is by means of two pins 34A rigidly connected with the outside part of the fork 34 that is located on the outer right side of the right part of the housing 41 where the pins pass through the slot 41E. On the outer side of the right part of the housing 41, a spring 41G is positioned in the spring receiving opening 41F.

For a forced correct positioning of the rotating wheel 35 in the rear position (FIG. 10A, 11A) two conical plates 41J (only the right one is shown) or similar elements which are latched in the corresponding recesses 41H, 51H are located in the housing 31. A revision opening 51L is provided in the left side of the housing 51, where the said opening 51L is covered with a transparent covering element 51M.

Figure 9B:
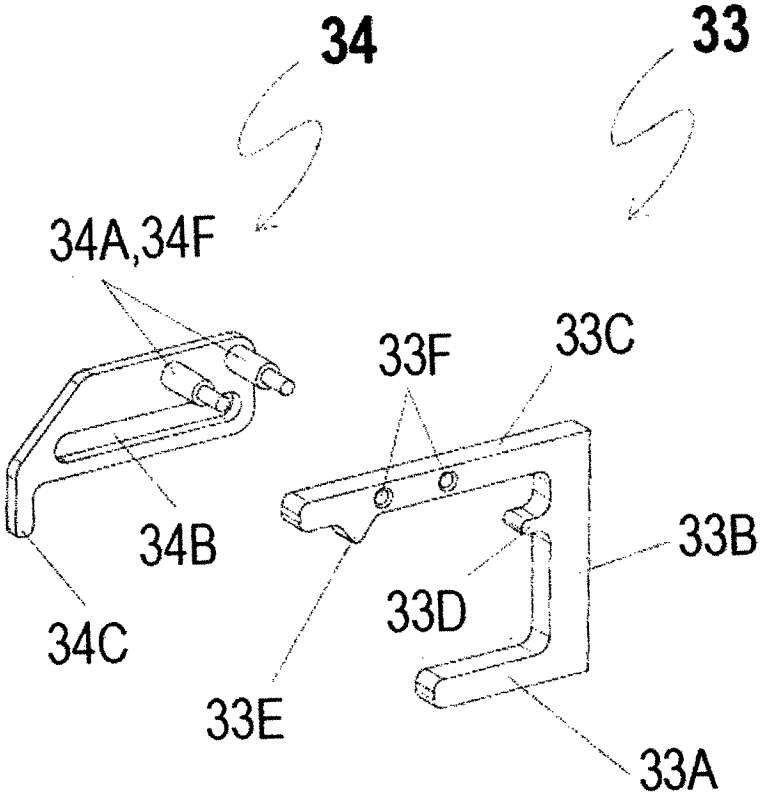
FIGS. 9A, 9B: The main elements of the rotating mechanism.
Figure 9A:
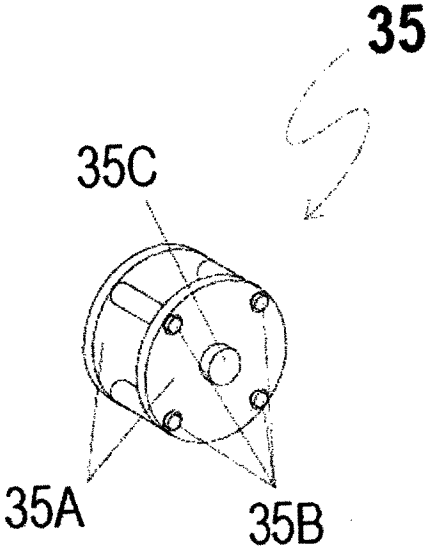

The rotating wheel 35 consists of two discs 35A which are located in parallel planes and interconnected by four pins 35B, uniformly distributed over the outer edges of said discs 35A, as shown in FIG. 9A.

From the outer side of each disc, a protruding pin 35C is located, fitting into the corresponding slot 41A, 51A. The pin 35C located on the outer side of the right part of the housing 41 protrudes from the housing 41 by a distance not greater than the thickness of the outer fork 34, and pin 35C on the outer side of the left part of the housing 51 protrudes from the housing 31 by the same distance or it is aligned with the housing.

The depth if said recesses 41D and 51D of the left part 51 and right part 41 of the housing 31 is equivalent to the sum of the thickness of discs 35A, thickness of plates 41J and a clearance between 0.5 mm and 1 mm, thereby allowing free rotation of rotating wheel 35. The distance between the discs 35A is approximately the same as the distance between two adjacent pins 35B and corresponds to the largest diameter of the cartridge N, increased by the necessary clearance which in dependence on the largest diameter of the cartridge ranges between 0.5 mm and 2 mm, preferably between 1 mm and 1.5 mm.

The rear fork 33 is shown in FIG. 9B and contains a bottom, horizontal arm 33A, the vertical portion 33B with a protruding cam surface 33D and the upper horizontal arm 33C with a downwardly protruding cam surface 33E and two openings 33F for connection with the outer part of the fork 34.

FIG. 9B also shows the outer part of the fork 34 consisting of a flat portion which has two openings 34F in the upper rear part with inserted pins 34A for connecting to the rear fork 33. There is a slot 34B in the central part of the outer fork portion 34 through which extends a pin 13D1, where the slot 34B runs practically along the entire length of the outer fork portion 34, and in the front part of fork 34 there is a downward protruding lever 34C.

In the assembled state, the housing 31 has a vertical opening 31A in the upper part, with essentially a round cross section, through which individual cartridges enter into the housing 31.

Figure 7:
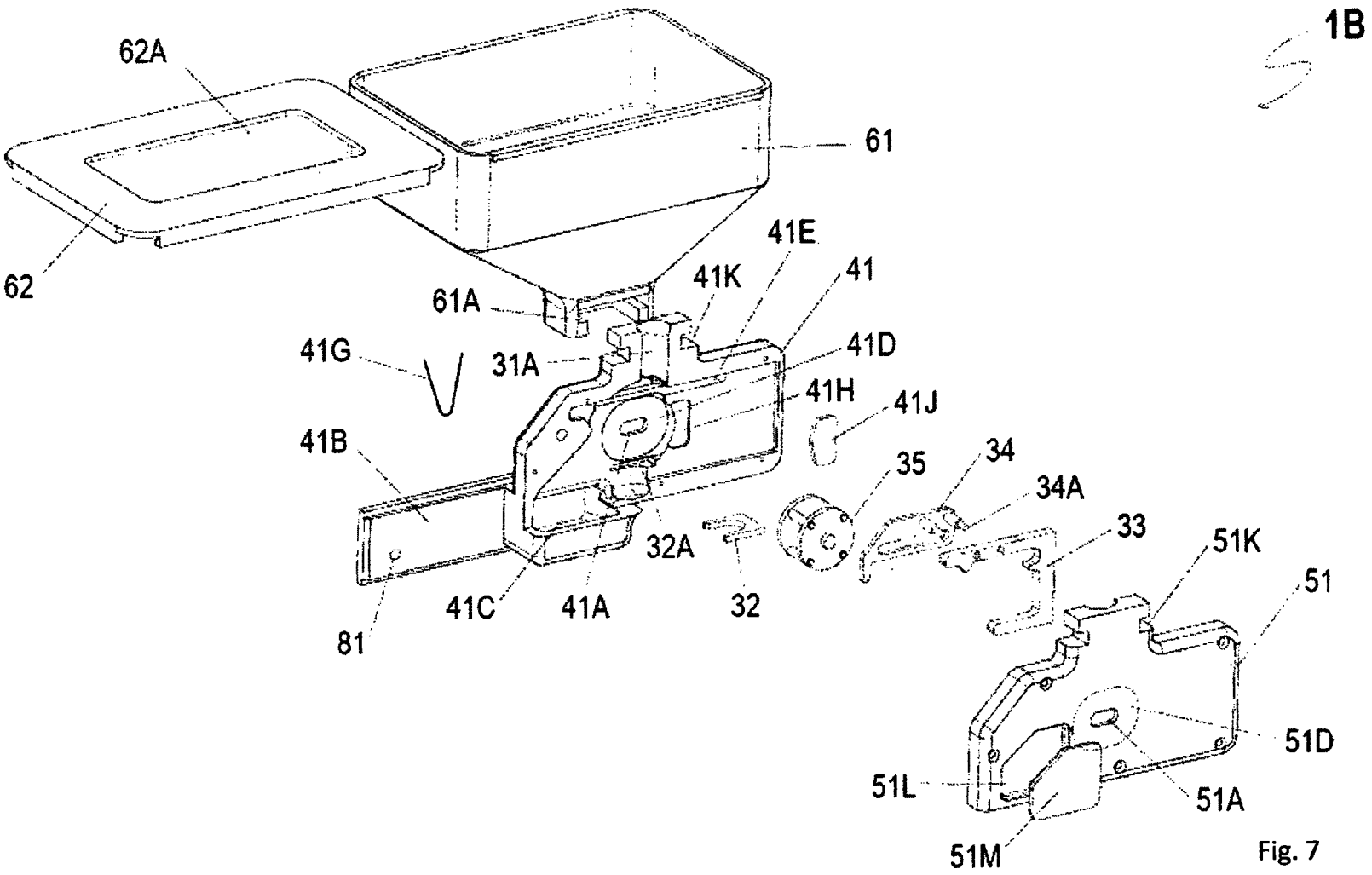
FIG. 7: The upper section 1B of the device according to the present invention in disassembled state, front, left and top side view.
Figure 8A:
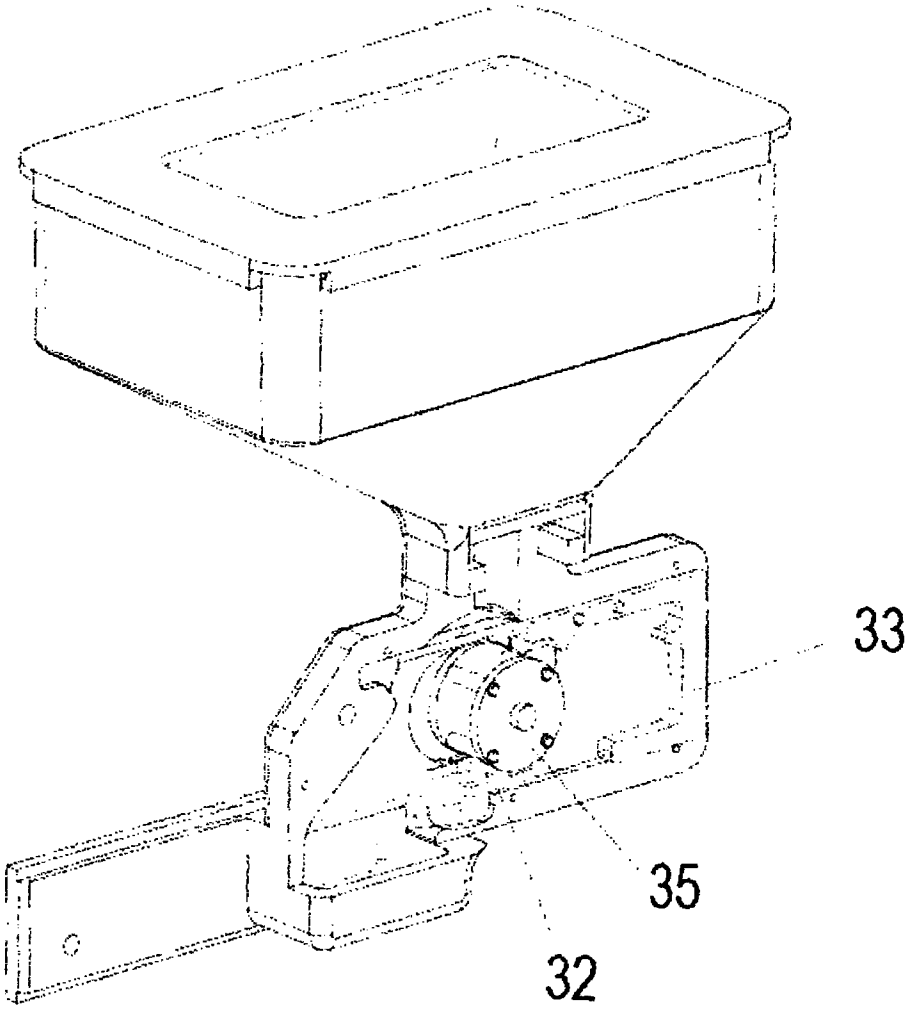
FIG. 8A: The upper section 1B of the device according to the present invention with displayed revolving mechanism, front, left and top side view.
Figure 8B:
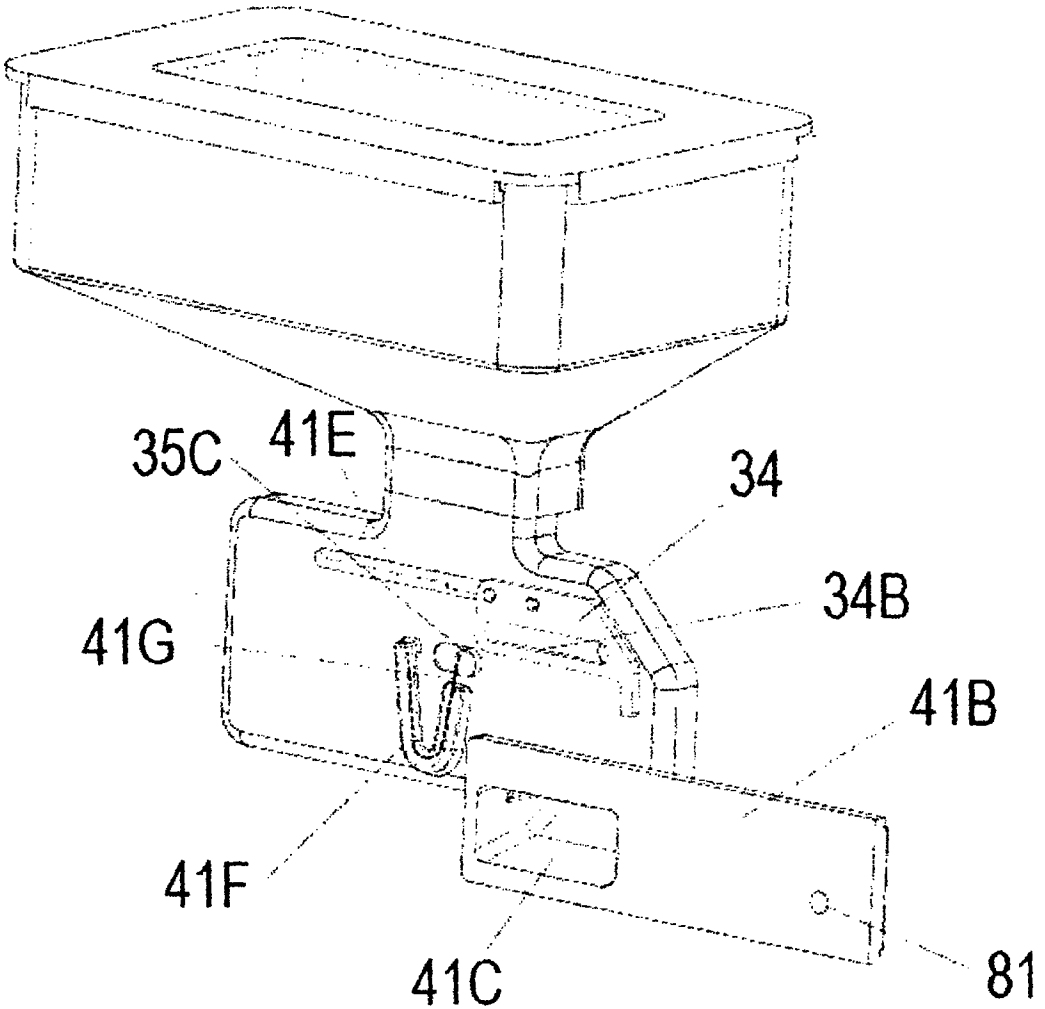
FIG. 8B: The upper section 1B of the device according to the invention, front, right and top side view.

As shown in FIG. 7, a hopper 61 is attached to the slider 41K, 51K of the circumference of said inlet opening 31A, where the hopper 61 is covered with a seal 62 with a revision opening 62A, which is preferably covered with a transparent layer, such as plexiglass or similar.

FIGS. 10A to 10E and 11A to 11E schematically show the assembled device 1, wherein the upper section 1B is clamped to the lower section 1A in a manner as described above. The grip 21B, 22B of the lower section 1A of the device 1 is not shown.

Description of Device Operation

The cartridges are freely dropped into the hopper 61, covered with the seal 62. The user holds the device 1 in one hand, while at the same time, with the other hand, pulls back, i.e. towards his body, the latch 13 by means of the pull handle 14. The pin 13D1 fixed in the opening 13D of the latch 13 travels along the groove 34B of the outer fork 34 at idle until it reaches the back wall of the groove 34B and pulls the outer fork 34 to the rear position, consequently also moving the rear fork 33 to the rear position. The lever 34C of the outer fork 34 also moves the pin 35C and consequently the rotating wheel 35 to the rear position, and tensions the front arm of the spring 41G, which protrudes from the receiver 41F. The upper horizontal arm 33C of the rear fork 33 is not closing the inlet opening 31A anymore.

When the latch 13 is removed from the foremost position, it initially moves alone until the pin 13D1 reaches the rear wall of the slot 34B of the outer fork 34, which are through the opening 41E rigidly coupled with the rear fork 33 by means of pins 34A. From here onwards the latch 13, the outer fork 34 and the rear fork 33 move together towards the rear position until they reach the point where the vertical lever 34C of the outer fork 34 reaches the right pin 35C of the rotating wheel 35. From here onwards the rotating wheel 35 moves together with the above mentioned elements towards the rear position.

Consequently, the stroke length, i.e. the length between the front most position and rearmost position, of the latch 13 is longer than the stroke length of the outer fork 34 and outer fork 33 assembly, which is however longer than the stroke length of the rotating wheel 35.

As mentioned above, the cartridge N may fall from the hopper 61 through the opening 31A into the housing 31 of the lower section 1B with bullet facing down or sleeve facing down. By pulling the latch 13 the hopper shakes and consequently the cartridges cannot get jammed.

Operation of the upper section 1B for both possibilities is described hereunder.

Cartridge with Bullet Facing Down

Figure 10A:
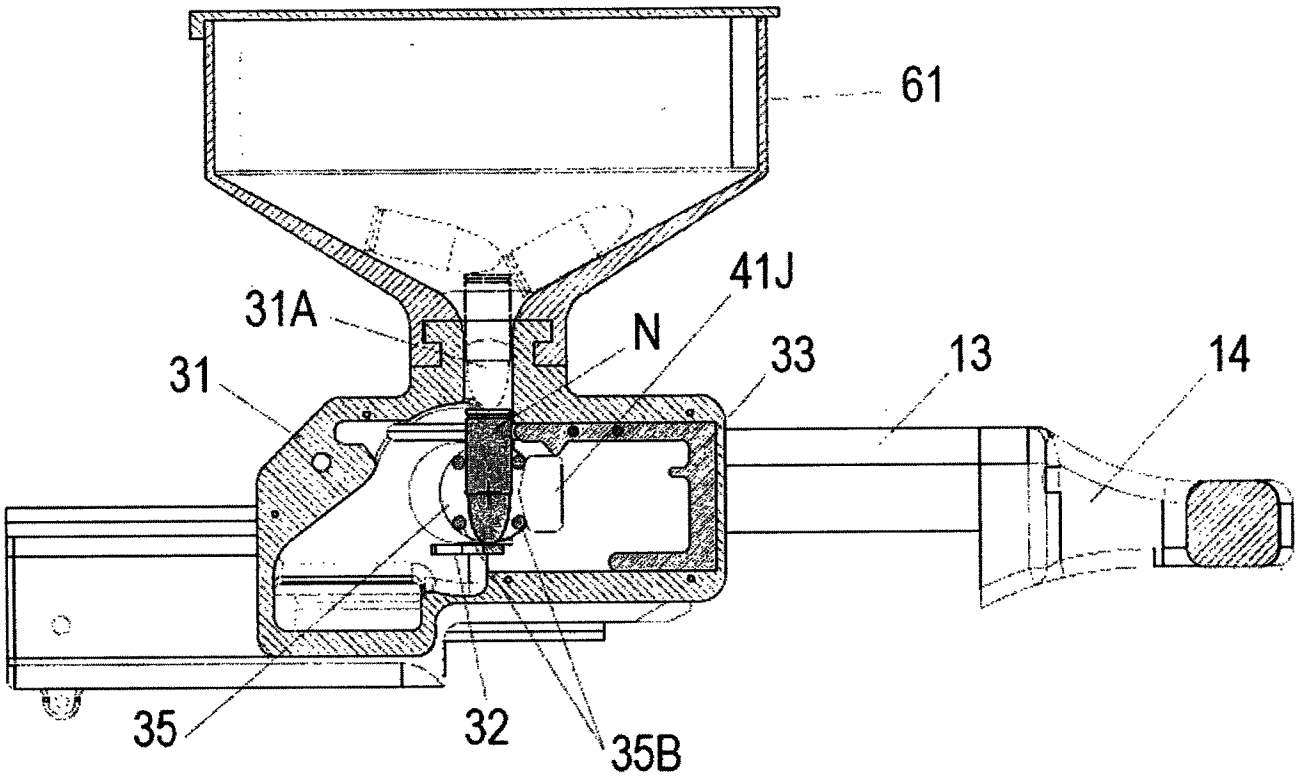
FIGS. 10A to 10E: Step-by-step illustration of the function of the upper section 1B of the device and rotating mechanism in case the cartridge is placed in the mechanism bullet down.

FIG. 10A shows a position where the latch is in its rearmost position, the upper horizontal arm 33C of the rear fork 33 is withdrawn in the rearmost position, and the rotating wheel 35 is in the rearmost position, where both rear pins 35B engage on the conical plates 41J, whereby the rotating wheel 35 is forcibly placed in the correct position. The cartridge N falls from the hopper 61 through the opening 31A into the housing 31 of the upper section of the device 2 with bullet facing down and stops on the lower fork 32, in the rotating wheel 35, between two adjacent pins 35B.

Figure 10B:
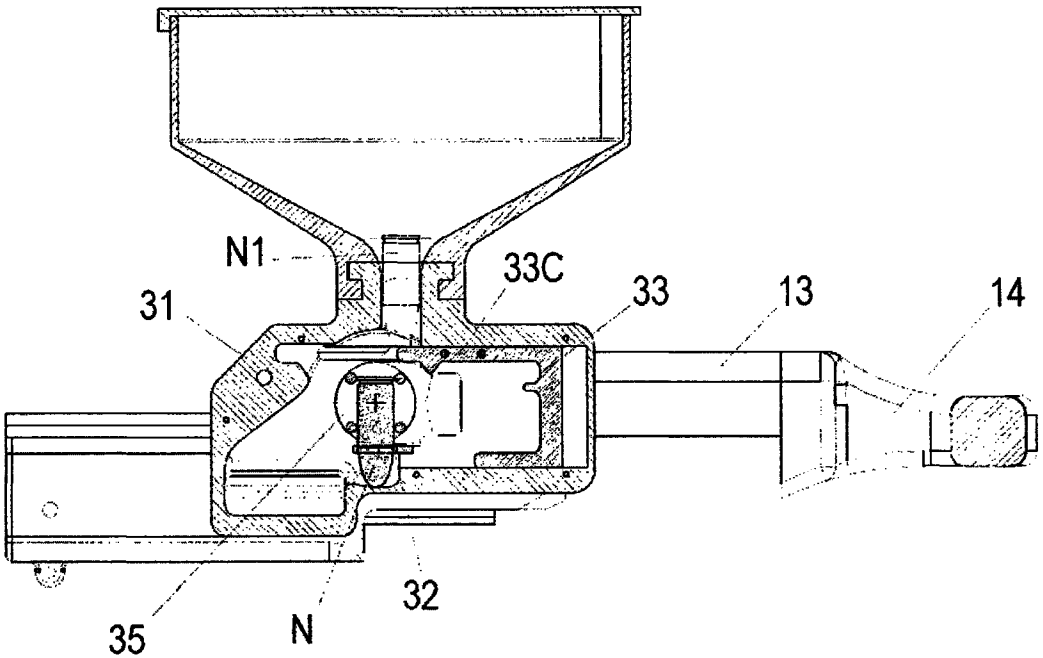

FIG. 10B shows the next step wherein the user releases the pull force on the latch 13 and the spring 15A is pushed forward by the lock 13, the spring 41G moves the pin 35C and with it the rotating wheel 35, where the cartridge N is located, to the front most position. The upper horizontal arm 33C of the rear fork 33 has been moved forward, whereby entry of the next cartridge N1 into the housing 31 is made impossible. The cartridge N with the bullet facing down falls through the gap of the lower fork 32 by the length of the bullet.

Figure 10C:
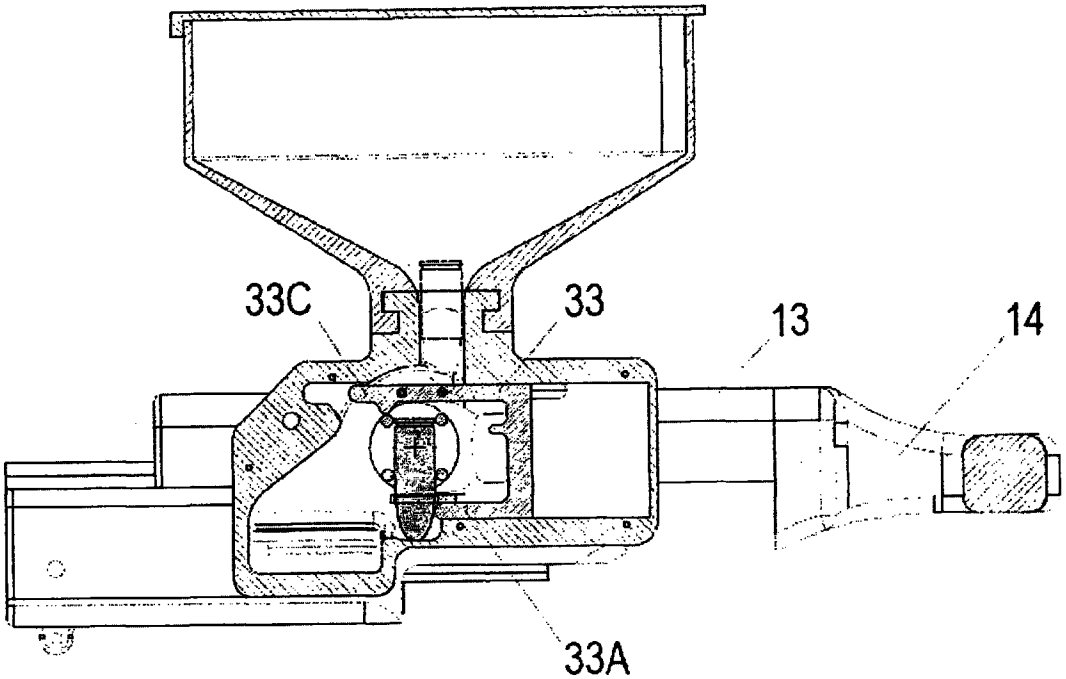

FIG. 10C shows the next step where the user further releases the pull force on the latch 13. The upper horizontal arm 33C of the rear fork 33 in this case has no role and passes over the cartridge N and the rotating wheel 35 towards front most position. The lower arm 33A of the rear fork 33 reaches the bullet of the cartridge N.

Figure 10D:
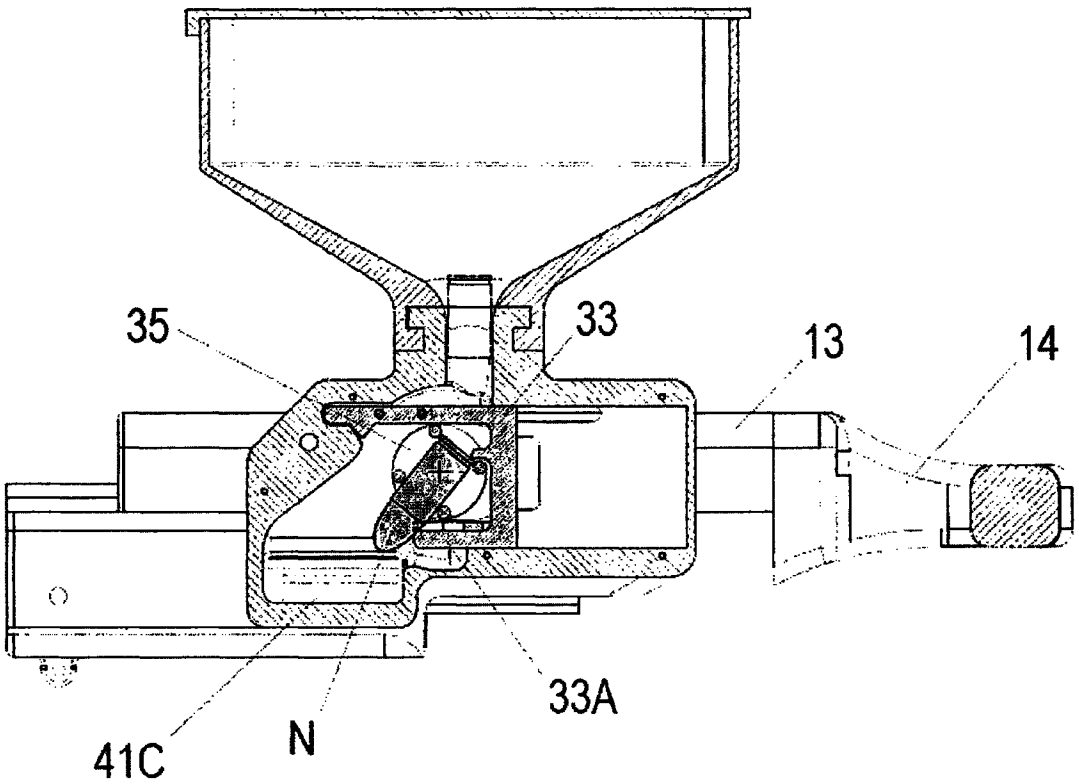
Figure 10E:
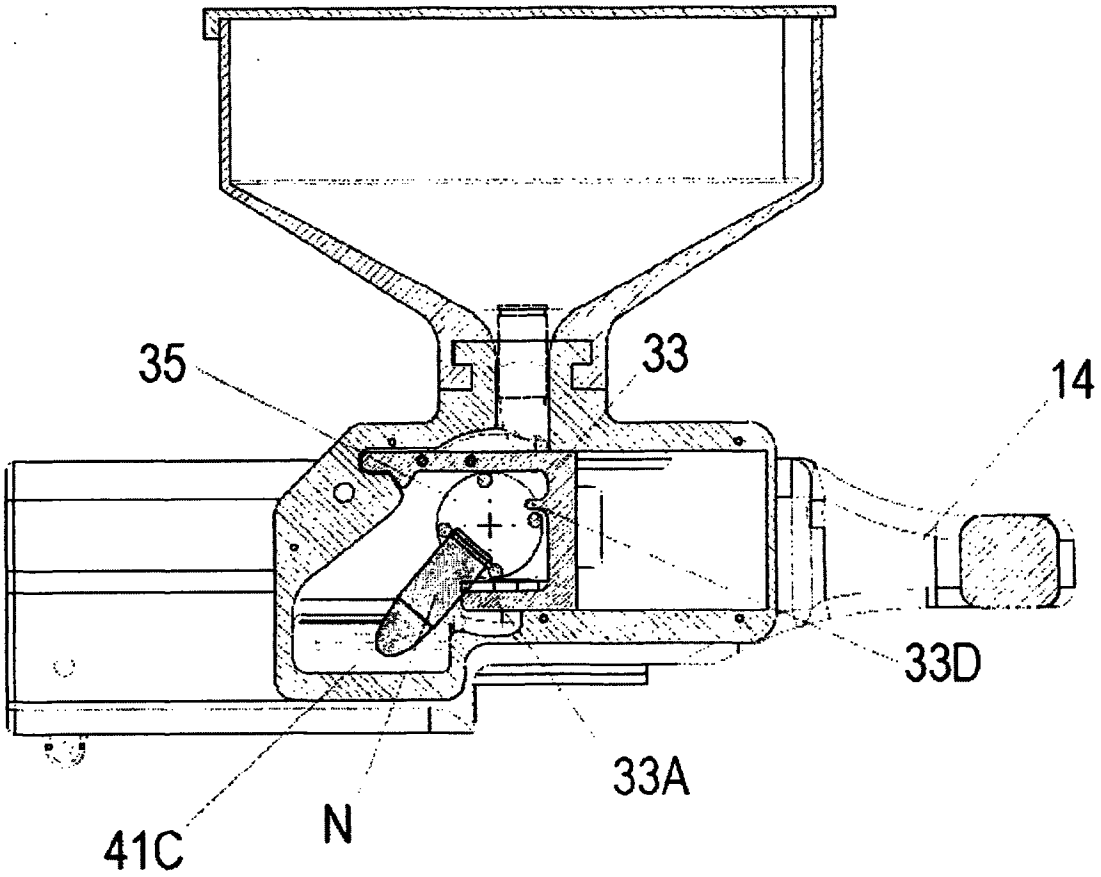

As shown in FIGS. 10D and 10E, the lower arm 33A of the rear fork 33, during further travel forward, pushes the cartridge N, which is located in the rotating wheel 35, and therefore the rotating wheel 35 rotates, the protruding cam surface 33D reaches the rotating wheel 35 and the correctly facing cartridge N, falls from the rotating wheel 35 into the opening 41C, and through it into the opening 12E in the lower section 1A of the device 1.

Cartridge with Bullet End Facing Down

Figure 11A:
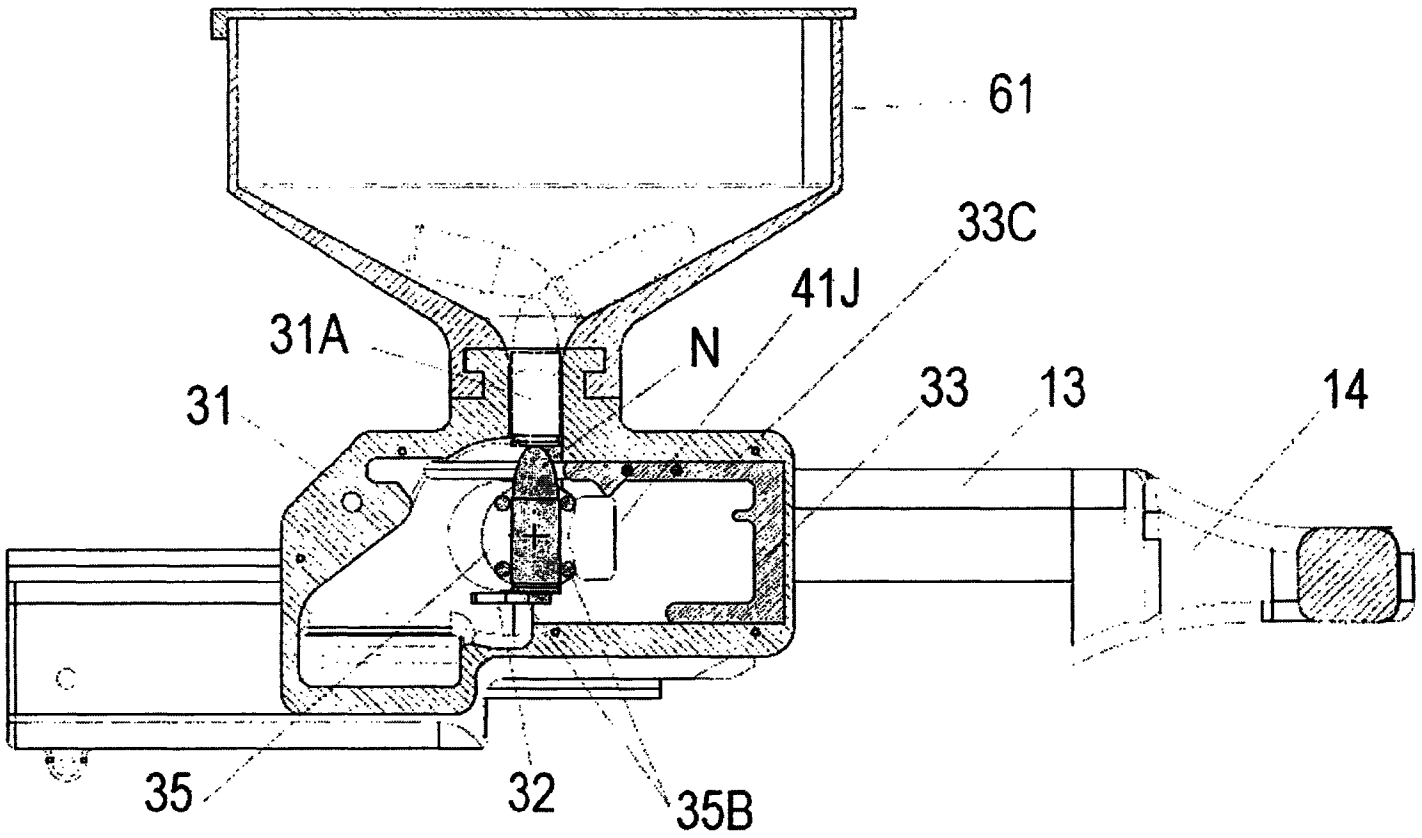
FIGS. 11A to 11E: Step-by-step illustration of the function of the upper section 1B of the device and rotating mechanism in case the cartridge is placed in the mechanism bullet up.

FIG. 11A shows the same position as FIG. 10A where the cartridge N has fallen from hopper 61 through the opening 31A into the housing 31 of the upper section of the device 2 with the sleeve facing down. The cartridge N stops on the lower fork 32, in the rotating wheel 35, between two adjacent pins 35B.

Figure 11B:
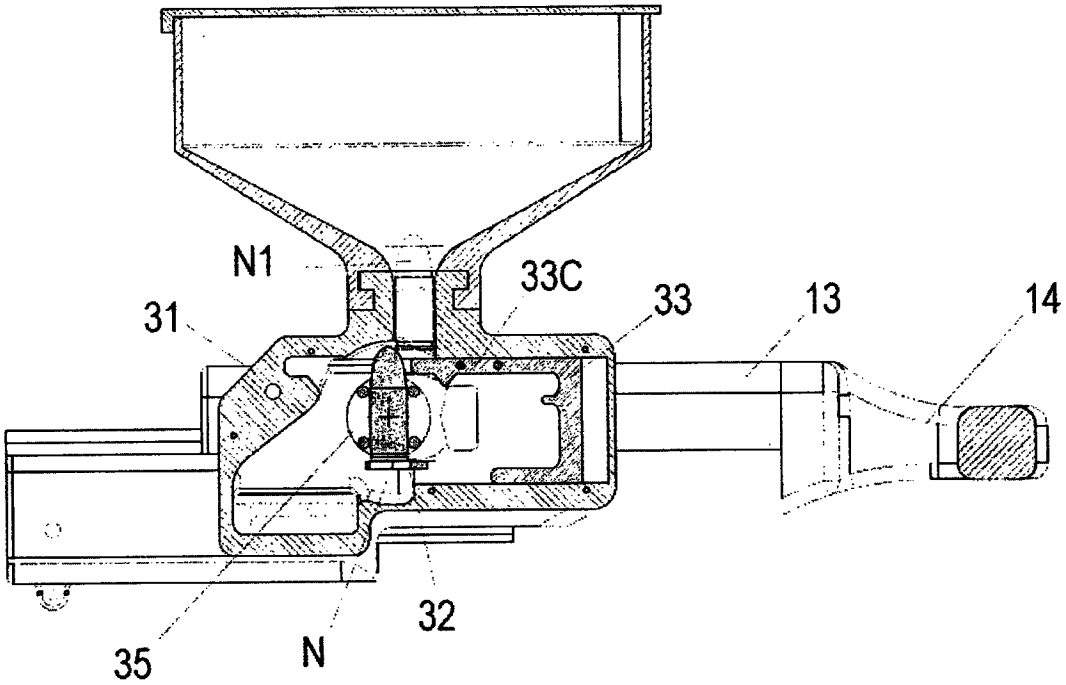
Figure 11C:
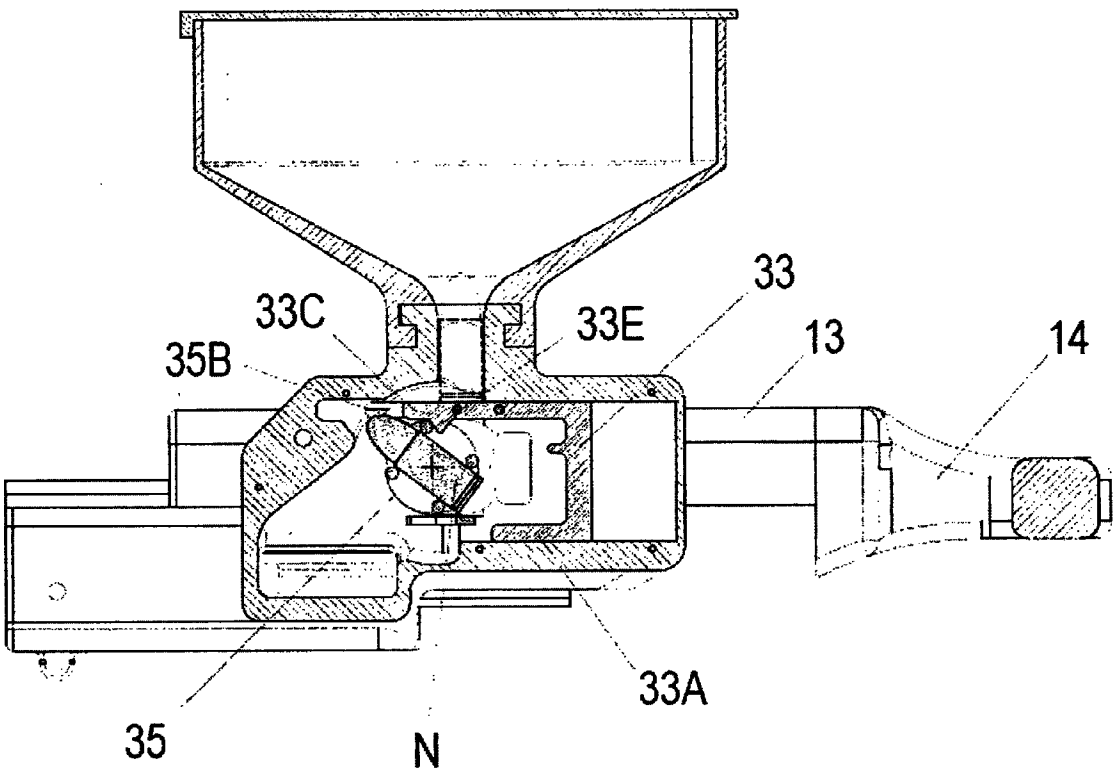

FIG. 11B shows the next step wherein the user releases the pull force on the latch and the spring 15A is pushed forward by the lock 13, the spring 41G moves the pin 35C and with it the rotating wheel 35, which holds the cartridge N, to the front most position. The upper horizontal arm 33C of the rear fork 33 has been moved forward, whereby entry of the next cartridge N1 into the housing 31 is prevented. The cartridge N with the sleeve facing down slides along the upper surface of lower fork 32. FIG. 11C shows the next step where the user further releases the pull force on the latch 13. The lower horizontal arm 33A of the rear fork 33 in this case has no role and passes over the cartridge N and the rotating wheel 35 under the lower fork 32 towards the end position.

The upper horizontal arm 33C of the rear fork 33 reaches the bullet of the cartridge N and the rotating wheel 35 rotates partially towards the front side of the device. During the rear fork forward motion, the protruding cam surface 33E reaches the upper rear pin 35B of the rotating wheel 35 rotating it for the remainder of the stroke to such an extent that the cartridge N is in a horizontal position with the bullet facing forward.

Figure 11D:
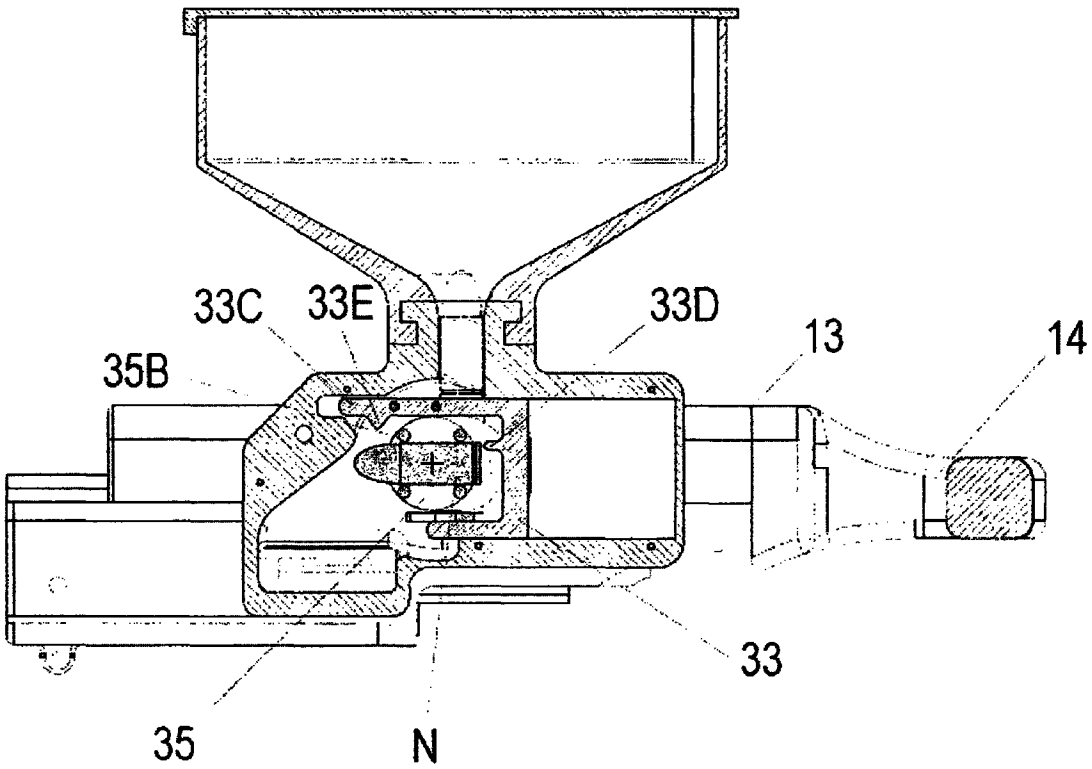
Figure 11E:
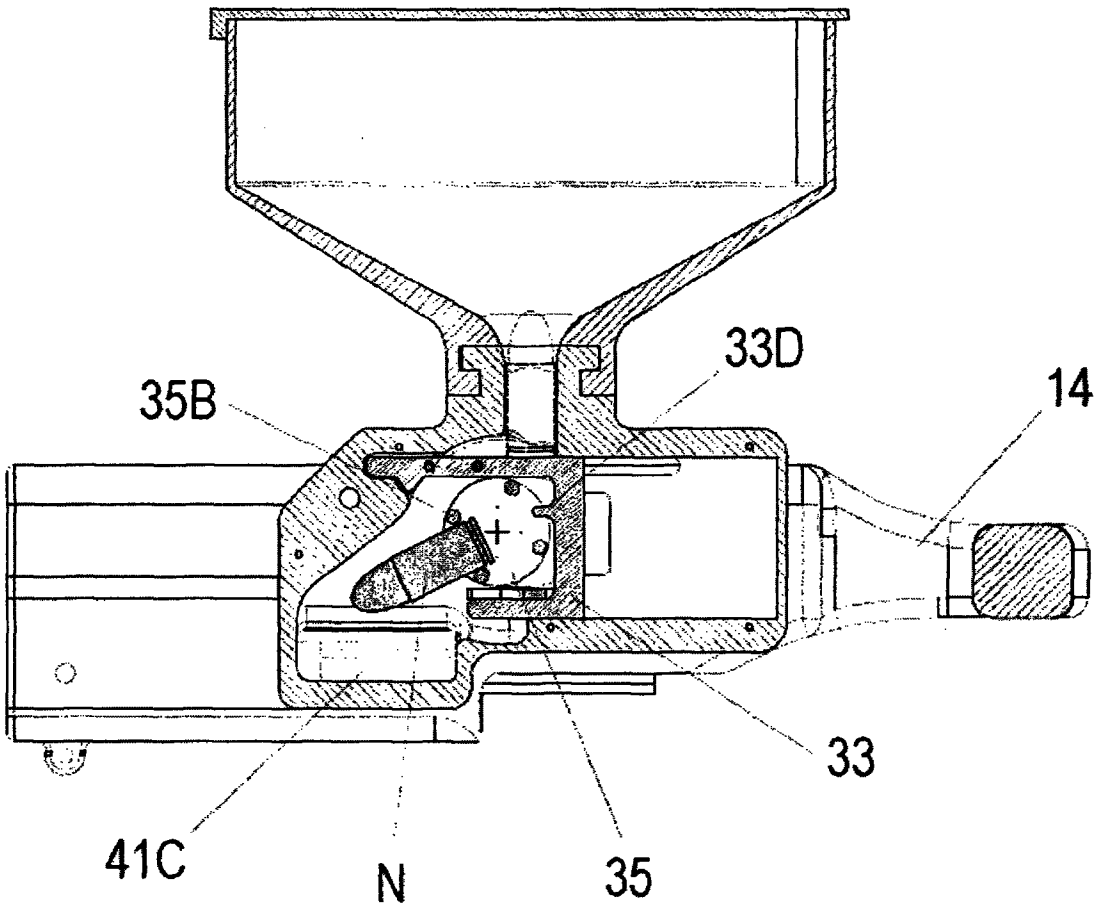

As shown in FIGS. 11D and 11E, the rear fork 33 during forward travel reaches the cartridge N with the protruding cam surface 33D pushing it forward from the rotating wheel 35 so that the rotating wheel 35 rotates by approximately 45° due to the weight of the cartridge, which facing correctly falls from the rotating wheel 35 into the opening 41C and through it into the opening 12E in the lower section 1A of the device 1.

The operation of the entire device is clear from the above description of operation of both sections 1A, 1B of the device 1. Namely, when inserting magazine 20 in the device 1 and dropping the cartridges in the hopper 61, in the first cycle which starts with the movement of the latch 13 to the rearmost position and finishes with the return stroke of the latch 13 in the front most position, the cartridge N travels from the hopper 61 through the opening 31A into the rotating wheel 35 and from said rotating wheel 35 the cartridge facing correctly falls into the opening 41C and through it into the opening 12E in the lower section 1A of the device 1.

In the second cycle, the cartridge N, which is after the first cycle located in the opening 12E, travels into magazine 20, while at the same time the next cartridge falls into the upper section 1B of the device.

It is therefore a simultaneous operation of both parts of the device 1 where in the second and each subsequent cycle two cartridges travel through the device.

The materials of the said elements of the device according to the present inventions are known in the art. Springs, pins, wheel 17C of the plunger 17 and guide rod 15 are made from a suitable steel, parts 17A and 17B of the plunger 17 are made from aluminium or stainless steel, lock 13, pull handle 14, the housing of the lower section 11, 12, the housing of the upper section 31 are made of composite materials, stainless steel, aluminium alloy and the like, hopper 61 and cover 62 are preferably made of plastic. Movable parts such as forks 32, 33 and 34, plates 41J, rotating wheel 35 are made of suitable steel which must have good sliding properties and is resistant to corrosion. Such materials are known in the art, and therefore will not be specifically described herein.

The device 1 according to the present invention as described above is intended for manual use and enables loading of cartridges (N) into a magazine (20) at a rate of 0.5 to 2 cartridges per second, preferably 1 cartridge per second.

According to the present invention the device can with minimal adjustments be reworked so that the device can be power-driven by means of a suitable unit such as an electric motor and the like, in combination with a suitable element that converts the rotational movement into translational movement (crank mechanism and eccentric cam), while it is also possible to introduce a pneumatically-driven piston unit and the like. In such case, the above said pull handle 14 should be replaced with a handle shaped so as to permit connection with the drive unit, for example by means of a pin, whereby the handle of the lower section of the device must be rigidly clamped in a suitable clamping device.

The device according to the present invention has been described and detailed in the attached drawings in an understandable manned and by means of concrete examples of use and operation. Various version of this device are possible, which however fall within the scope of this invention.

The invention claimed is:

1. A magazine loader device (1) comprising:

a lower section (1A) comprising:

a lower housing comprising:

a right part (11) having a right upper guide (11A) and a right lower guide (11B); and a left part (12) having a left upper guide (12A) and a left lower guide (12B);

wherein the right and left parts (11,12) further comprise respective lower sections (21B,22B) that are configured to assemble together and form a hollow grip within which a magazine (20) can be inserted;

a latch (13) comprising:

a first guide (13B) extending a length of the latch (13) and configured to slideably engage with the right and left upper guides (11A,12A); and a second guide (13C) formed on a front portion of the latch (13) and configured to slideably engage with the right and left lower guides (11A,11B);

a pull handle (14) coupled to the latch (13);

a spring guide rod (15) disposed within a front opening (13F) of the latch (13);

a spring (15A) disposed on the spring guide rod (15);

a tripping plunger (17) having a wheel (17C) configured to travel along a controlling curve (13E) within the latch (13) during operation of the device (1); and a pin (18) and a preloaded spring (18A) configured to provide return vertical motion of the tripping plunger (17).

2. The device (1) of claim 1 further comprising:

an upper section (1B) comprising:

an upper housing (31) having a revision opening (51L) on a right side (51) thereof;

a transparent covering element (51M) enclosing the revision opening (51L);

a lower fork (32), a rear fork (33), plates (41J), and a rotating wheel (35) positioned within the upper housing (31);

a hopper (61) fitted onto the upper housing (31) with a seal (62), wherein the hopper (61) and the upper housing (31) are connected through an inlet opening (31A) for cartridges (N);

a spring (41G) formed on a right side (41) of the upper housing (31); and an outer fork (34) rigidly connected to the rear fork (33) with pins (34A);

wherein the lower section (1A) and the upper section (1B) are rigidly interconnected with a sliding rail (41B) located on the right side (41) of the upper housing (31), guides (12F) on the lower housing, and a pin running through an opening (81) on the sliding rail (41B) and an opening (82) in the lower housing.

3. The device (1) of claim 2 wherein the rear fork (33) comprises a lower, horizontal arm (33A), a vertical member (33B) with a protruding cam surface (33D), an upper horizontal arm (33C) with a downward protruding cam surface (33E), and two holes (33F) configured to receive the outer fork (34);

wherein the outer fork (34) contains a slot (34B); and wherein a pin (13D1) fixed in an opening (13D) of the latch (13) is configured to travel within the slot (34B).

4. The device (1) of claim 2 wherein the rotating wheel (35) comprises two discs (35A) which are located in parallel planes and are interconnected by four pins (35B) which are uniformly distributed across the outer edges of the two discs (35A); and wherein each of the two discs (35A) has an extended pin (35C) on the outer side thereof.

5. The device (1) of claim 2 wherein the latch (13) has a stroke length that is greater than a stroke length of the outer fork (34); and wherein the rotating wheel (35) has a stroke length that is smaller than the stroke length of the outer fork (34).

6. The device (1) of claim 2 further comprising plates (41J) positioned within the upper housing (31) and configured to forcibly position the rotating wheel (35) in a position for receiving a cartridge (N).

7. The device (1) of claim 2 wherein the rotating wheel (35), the rear fork (33), and the lower fork (32) are configured to deposit a cartridge (N) into the lower section (1A)

with a bullet end of the cartridge (N) facing down irrespective of whether the cartridge (N) falls into the opening (31A) with the bullet end facing down or a sleeve end facing down.

8. The device (1) of claim 2 wherein if a cartridge (N) falls into the opening (31A) with a bullet end thereof facing down, a lower horizontal arm (33A) of the rear fork (33) is configured to turn the rotating wheel (35) by 45° so that the cartridge (N) is discharged from the rotating wheel (35) into the lower section (1A) with the bullet end thereof facing down.

9. The device (1) of claim 2 wherein if a cartridge (N) falls into the opening (31A) with a sleeve end thereof facing down, an upper horizontal arm (33C) and a protruding cam surface (33E) of the rear fork (33) are configured to turn the rotating wheel (35) by 90° and a protruding cam surface (33D) of the rear fork (33) is configured to pushes the cartridge (N) from the rotating wheel (35) by means of protruding cam surface (33D) so that the rotating wheel (35) turns in the same direction for another 45° due to the weight of the cartridge (N) so that the cartridge (N) is discharged from the rotating wheel (35) into the lower section (1A) with a bullet end thereof facing down.

10. The device (1) of claim 2 wherein no more than two cartridges (N) can travel through the device simultaneously, wherein no more than one cartridge (N) travels through the lower section (1A) towards magazine (20) and wherein no more than one cartridge (N) travels through the upper section (1B) of the device towards the lower section (1A) of the device during operation.

11. The device (1) of claim 2, wherein the lower section (1A) can be used independently without the upper section (1B).

12. The device (1) of claim 1 wherein the tripping plunger (17) further comprises a lower portion (17A) joined to an upper portion (17B) by a first pin (17F), a spring (17D), and a second pin (17E) inserted through the upper portion (17B) and the wheel (17C);

wherein the tripping plunger (17) is configured to slide along vertical guides (11C,12C) provided on the left and right parts (11,12) of the lower housing;

wherein the preloaded spring (18A) is configured to push the tripping plunger (17) upwards to the controlling curve (13E); and wherein the upper and lower portions (17B, 17A) of the tripping plunger (17) are configured to move around an axis of the first pin (17F) only if the upper portion (17B) rotates forward, while the rotation in the opposite direction is prevented.

13. The device (1) of claim 1 wherein the lower sections (21B, 22B) of the lower housing and the pull handle (14) are removable.

14. The device (1) of claim 1 wherein the device is constructed to permit loading of cartridges (N) into the magazine (20) at a rate of 0.5 to 2 cartridges per second.

* * * * *